US012473717B2

(12) United States Patent
Jordi et al.

(10) Patent No.: US 12,473,717 B2
(45) Date of Patent: Nov. 18, 2025

(54) PROTECTIVE CAPSULES FOR EARTH MOVING MACHINES HAVING A SLOT ANTENNA

(71) Applicant: METALOGENIA RESEARCH & TECHNOLOGIES, S.L., Barcelona (ES)

(72) Inventors: Marquez Llinas Jordi, Terrassa (ES); Gimeno Tordera Albert, Barcelona (ES); Ferrandiz Borras Vicent, Sant Cugat del Valles (ES); Vallvé Bertran Nil, Cabrera de Mar (ES)

(73) Assignee: METALOGENIA RESEARCH & TECHNOLOGIES, S.L., Barcelona (ES)

( * ) Notice: Subject to any disclaimer, the term of this patent is extended or adjusted under 35 U.S.C. 154(b) by 369 days.

(21) Appl. No.: 18/251,012

(22) PCT Filed: Oct. 28, 2021

(86) PCT No.: PCT/EP2021/080031
§ 371 (c)(1),
(2) Date: Apr. 28, 2023

(87) PCT Pub. No.: WO2022/090412
PCT Pub. Date: May 5, 2022

(65) Prior Publication Data

US 2023/0407606 A1 Dec. 21, 2023

(30) Foreign Application Priority Data

Oct. 28, 2020 (EP) ..... 20382939
Feb. 25, 2021 (EP) ..... 21382164

(51) Int. Cl.
*E02F 9/26* (2006.01)
*E02F 9/28* (2006.01)

(52) U.S. Cl.
CPC ..... *E02F 9/264* (2013.01); *E02F 9/2808* (2013.01); *E02F 9/2883* (2013.01)

(58) Field of Classification Search
USPC ..... 73/431
See application file for complete search history.

(56) References Cited

U.S. PATENT DOCUMENTS

2012/0282507 A1 11/2012 Andre et al.
2014/0253131 A1 9/2014 Liu et al.
(Continued)

FOREIGN PATENT DOCUMENTS

AU 2012215112 A1 8/2013
EP 3327205 A1 5/2018
(Continued)

OTHER PUBLICATIONS

International Search Report for related application PCT/EP2021/080031 prepared by the European Patent Organization and having a mailing date of Feb. 9, 2022.
(Continued)

*Primary Examiner* — Walter L Lindsay, Jr.
*Assistant Examiner* — Warren K Fenwick
(74) *Attorney, Agent, or Firm* — Snell & Wilmer LLP

(57) ABSTRACT

A capsule for protecting an electronic device for an earth moving machine, the capsule comprising walls enclosing an inner chamber configured for housing an electronic device or components thereof, the capsule comprising a slot antenna arranged in at least one of the walls, the at least one of the walls in which the slot antenna is arranged is a cover that can be removably coupled to one or more of the walls of the capsule. Also, a device for an earth moving machine comprising a capsule, a process of manufacturing a capsule, and a process of manufacturing a device for an earth moving machine.

20 Claims, 13 Drawing Sheets

(56) References Cited

U.S. PATENT DOCUMENTS

| | | | | |
|---|---|---|---|---|
| 2015/0284935 | A1* | 10/2015 | Egger | E02F 9/2808 701/34.4 |
| 2015/0284995 | A1 | 10/2015 | Egger et al. | |
| 2018/0127952 | A1 | 5/2018 | Magliulo et al. | |
| 2020/0055631 | A1 | 2/2020 | Combs | |
| 2020/0088617 | A1* | 3/2020 | Marquez Llinas | E02F 9/264 |
| 2024/0011254 | A1* | 1/2024 | Jordi | E02F 9/2883 |

FOREIGN PATENT DOCUMENTS

| | | | |
|---|---|---|---|
| EP | 3715537 | A1 | 9/2020 |
| JP | 2000229781 | A | 8/2000 |
| WO | 2012107848 | A1 | 8/2012 |
| WO | 2012116408 | A1 | 9/2012 |
| WO | 2016131007 | A1 | 8/2016 |
| WO | 2016131015 | A2 | 8/2016 |
| WO | 2017017289 | A1 | 2/2017 |

OTHER PUBLICATIONS

Written Opinion of the International Searching Authority for related application PCT/EP2021/080031 prepared by the European Patent Organization and having a mailing date of Feb. 9, 2022.

* cited by examiner

PROTECTIVE CAPSULES FOR EARTH MOVING MACHINES HAVING A SLOT ANTENNA

TECHNICAL FIELD

The present disclosure relates to the field of earth moving machines. More particularly, the present disclosure relates to capsules and apparatuses for earth moving machines that, for instance, can be introduced in wear elements thereof or the digging implements, to name a few devices of said machines, and where the capsules and apparatuses are capable of transmitting and/or receiving data with an antenna.

STATE OF THE ART

Earth moving machines such as excavators or loaders, for example, comprise digging implements, e.g. bucket, shovel, dredgehead, etc., in which the material is pushed, pulled and/or collected. The digging implements, e.g. the bucket, are subjected to high stresses and significant wear, mainly in the area referred to as blade. For this reason, blades usually have a plurality of protective elements installed thereto which protect the blade and the digging implements against wear. Protective elements also increase the penetration of the digging implements into the terrain and the scratching of the terrain by the digging implements.

All these elements are subjected to intense mechanical requirements, straining and heavy wear. For this reason, they usually must be replaced with certain frequency, when the wear experienced requires it. As a whole, these protective elements are usually referred to as wear elements or ground engaging tools, i.e. GETs.

In order to monitor the wear or any status of the wear elements, the status of other parts of the earth moving machine such as e.g. traction means, boom or stick, or other magnitudes that may influence the ground engaging operations or the machine itself, the different parts of the earth moving machine can include sensing devices that measure said magnitudes, e.g. the strain they are subjected to or any other parameter. However, the measurements and information resulting from processing the same (if any) remain within the location of the sensing devices, e.g. wear elements, traction means, a boom, a stick, a hydraulic cylinder, the digging implements, etc., since that is the location where the electronic devices for sensing are provided. To extract the data, wireless communications links are usually necessary to send the data to a remote device, for example a cabin of the earth moving machine, a control center, an Internet cloud, etc.

Therefore, in addition to the electronic devices for the measurements and as seen for instance in patent documents WO-2017017289-A1, WO-2012107848-A1, US-20150284935-A1 and WO-2012116408-A1, when devices of the machine like wear elements include sensing devices, they typically also include means for radiating and capturing electromagnetic waves such as RFID tags, antennas for near-field communications or antennas in the form of e.g. monopoles, in this way data of the sensing devices can be wirelessly communicated. Regarding the former two, the reach of the electromagnetic waves is usually limited. Regarding the latter, mechanical reliability of said antennas cannot be high enough so as to cope with the stresses that wear elements are subject to; also, the volume that said antennas require may preclude the integration thereof in certain devices like the wear elements, especially the lower the frequency of operation has to be.

Accordingly, there is an interest in providing protective capsules for earth moving machine that incorporate an antenna capable of both better withstanding the stresses of devices within earth moving machines and better radioelectric performance. The protective capsules are preferably attachable to or introducible in the devices of the earth moving machines. Further, there is also the interest of providing compact antennas that, in some embodiments, can operate at frequencies below 1000 MHz.

There is also an interest in providing earth moving machines, and especially devices thereof, with antennas that can withstand the stresses but without requiring protective capsules. In this sense, it would be preferrable to have apparatuses that provide the antenna capabilities that at the same time may protect elements within cavities of the earth moving machines while having a compact size.

SUMMARY

A first aspect of the disclosure relates to a capsule for protecting an electronic device for an earth moving machine, the capsule comprising: walls enclosing an inner chamber configured for housing an electronic device or at least one or more components thereof, and a slot antenna arranged in at least one of the walls.

The capsule makes possible to both protect an electronic device or one or more components thereof, and wirelessly transmit data of the electronic device to an electronic apparatus remote from the capsule and/or wirelessly receive data from a remote electronic apparatus and provide it to the electronic device. By way of example, the electronic device and/or one or more components thereof are, for example but without limitation, one or more sensing devices, one or more batteries, one or more memory units, etc. By way of example, the electronic apparatus can be a controller for supervising and/or operating the earth moving machine, and can be located e.g. in a control center, or in the earth moving machine, for example in a cabin thereof.

The capsule does not require the provision of an antenna such as a monopole, dipole, patch antenna, microchip antenna, etc. that takes space within the inner chamber or has to be attached to the capsule or to another part of the earth moving machine remote from the capsule. Notwithstanding, it is possible to arrange one or more antennas in addition to the slot antenna for wireless transmission and/or reception at frequencies other than the frequencies of operation of the slot antenna, or for redundancy purposes.

The capsule advantageously uses one or more walls thereof for the radiation and/or capturing of electromagnetic waves in order to wirelessly transmit and/or receive data. This, in turn, can make the overall volume needed for both the protection and wireless transmission/reception smaller, the reliability of the communications greater owing to an antenna less prone to damages, and/or the integration of the antenna in the earth moving machine simpler and more reliable too, especially when the capsule is to be introduced in or attached to a wear element, e.g. a tooth, an adapter, a cast lip, or the digging implements, e.g. a bucket. To this end, the capsule is preferably adapted for introduction in a cavity of or attachment to the wear element, the digging implements, a boom, a stick, a hydraulic cylinder, e.g. bucket cylinder, traction means, e.g. continuous tracks, or an underside of a cabin of the earth moving machine.

In some embodiments, the capsule further comprises dielectric material filling the slot of the slot antenna.

The dielectric material can be part of the wall or walls where the slot antenna is formed, be part of one or more components adapted to fill the slot of the slot antenna in a removable manner, for example a removably couplable lid or cap, or be part of a filling material that fills both the slot and the inner chamber with the electronic device therein by way of e.g. a potting process. Concerning the latter, as the material also fills the inner chamber it likewise protects the electronic device within the inner chamber. The dielectric material preferably fills the slot as much as possible so as to hermetically seal the inner chamber, thereby reducing or completely preventing the ingress of particles of the soil, for instance, or other particles capable of short-circuiting or affecting the radioelectric performance of the slot antenna. The dielectric material can be, for instance, epoxy, silicone, plastic, etc.

In some embodiments, the slot antenna is adapted for operation at a frequency less than 3000 MHz. In some embodiments, the frequency is between 2400 MHz and 2500 MHz.

The slot antenna is capable or further capable of radiating and/or capturing electromagnetic waves in e.g. the ISM band of 2.4 GHz to 2.5 GHz.

In some embodiments, the slot antenna is adapted or further adapted for operation at a frequency less than 1000 MHz.

In some embodiments, the frequency is between 430 MHz and 440 MHz. In some embodiments, the frequency is between 433.0 MHz and 435.0 MHz.

In some embodiments, the frequency is between 865.0 MHz and 870.0 MHz. In some embodiments, the frequency is between 900 MHz and 930 MHz.

The slot antenna is capable or further capable of radiating and/or capturing electromagnetic waves at frequencies below 1.0 GHz while being both compact in dimensions and mechanically more durable than antennas such as monopoles or patch antennas.

The slot antenna can radiate and/or capture electromagnetic waves in the ISM band in the frequency range of 430 MHz and 440 MHz, which features lower propagation losses than other bands at higher frequencies, and/or in one or more ISM bands within the frequency ranges of 865 MHz and 870 MHz, and 900 MHz and 930 MHz.

In some embodiments, at least one of the walls has a maximum length, i.e. the greatest dimension of the at least one of the walls where the slot antenna is arranged, in a particular longitudinal direction, a maximum width in a particular first transversal direction and a thickness in a second transversal direction, the maximum length is greater than or equal to the maximum width and the slot antenna has a maximum length, i.e. the greatest dimension of the slot antenna on the at least one of the walls, in the longitudinal direction which is at least 60% and is less than or equal to 100% of the maximum length of the at least one of the walls.

The slot antenna can take most of or the entirety of the length of the at least one of the walls for establishing a path for the currents to follow when electromagnetic waves are to be radiated or captured, thereby making possible to lower the frequency of operation of the slot antenna.

In some embodiments, the slot antenna is not a straight slot.

The slot antenna can include a plurality of segments, each segment being connected to one or more other segments along the length thereof such that longitudinal directions of the respective segments forms an angle therebetween, that is to say, two directly adjacent segments are connected such that they are not parallel. In this way, the effective length of the slot antenna that will determine the frequency or frequencies of operation can be increased.

In some embodiments, one or more segments of the plurality of segments of the slot antenna is/are straight. In some embodiments, one or more segments of the plurality of segments of the slot antenna is/are curvilinear.

In some embodiments, the at least one of the walls in which the antenna is arranged is a cover, and the cover can be removably coupled to one or more of the walls of the capsule.

The cover, being adapted to be removably coupled to said one or more walls, enables personnel to inspect, retrieve and/or replace any devices within the inner chamber after decoupling or detaching the cover. The electronic device can, for example, have one or more memory units in which data generated by circuitry, sensing devices and/or processors of the electronic device, is stored for ulterior processing thereof.

When the capsule is arranged in a wear element, the aforesaid operation or operations can take place whenever the wear element is to be replaced by another wear element owing to the wear and damages suffered by the wear element, either as part of maintenance tasks or upon failure of the concerned wear element or another wear element coupled thereto. The personnel can also replace e.g. a battery of the electronic device when the same has run out of energy rather than altogether replacing the electronic device, even though typically the wear element has a useful life shorter than that of a battery.

When the capsule is arranged in e.g. the digging implements, the boom, the stick, the hydraulic cylinder, the underside of the cabin, or the traction means, the aforesaid operation or operations can take place from time to time when performing maintenance of the earth moving machine or parts thereof, or as part of preventive maintenance tasks, for instance.

In some embodiments, the slot antenna is arranged in one wall of the capsule arranged on a rear end of the capsule.

In preferred embodiments, the capsule is to be arranged in a wear element of the earth moving machine such that the front end is facing towards a front relative of the machine and, thus, towards a ground to be engaged by the earth moving machine during operation of the machine.

In some embodiments, the capsule comprises two walls, the slot antenna being arranged in a first wall thereof and a second wall thereof being shaped according to a container. In some embodiments, the capsule comprises three or more walls, and the second wall and the third and further walls are mechanically coupled to form a container.

The capsule features the inner chamber for protecting the electronic device with just two walls, even though more walls are possible too, that need to be mechanically coupled together. A reduction in the number of walls can be advantageous from a mechanical standpoint because the mechanical coupling of walls oftentimes is the weakest part of a capsule. During operation of the earth moving machine, the strains or stresses applied to the capsule can break the capsule at the weakest part. The portion between the walls where walls are coupled may, in some occasions, has some space after coupling each pair of walls through which soil, be it dry or wet, can be introduced into the inner chamber and damage the protected electronic device.

In some embodiments, the capsule further comprises the electronic device, the electronic device comprises an electric power source; the electronic device is at least configured for wireless data transmission and is electrically connected to the slot antenna; and the inner chamber partially or completely houses the electronic device. In some embodiments, the electronic device is further configured for wireless data reception.

The electronic device or components thereof, while being protected by the capsule, may transmit data it generates or processes to other devices that are remote from the capsule. The electronic device is configured to transmit and/or receive data at the frequency or frequencies that the slot antenna operates. To this end, the electronic device comprises a wireless communications module, e.g. a modem, for transmitting data by means of a communications protocol or standard operating at one or more frequency bandwidths; the capsule also protects the wireless communications module. The communications protocol or standard uses a bandwidth of operation having one or more frequencies that the slot antenna is adapted to radiate and capture electromagnetic waves.

Further, in some cases, the electronic device may also receive data from devices remote from the capsule, such as commands to change the way the electronic device operates, e.g. go into a dormant state, wake up from a dormant state, change the frequency with which the electronic device generates, processes and/or transmits data, change the type of processing applied to the data, etc.

The inner chamber partially houses the electronic device when only one or some components of the electronic device are within the inner chamber, and completely houses the electronic device when the entire device is within the inner chamber.

In some embodiments, the electronic device further comprises at least one sensor configured for sensing changes in a device of the earth moving machine where the capsule is intended to be installed. In some embodiments, the at least one sensor is configured to sense one or more of: strain, wear, pressure, temperature, acceleration, position (e.g. a GPS), material/terrain (for identification thereof), and falling off of a wear element.

The electronic device can process measurements of the at least one sensor and transmit them with the slot antenna to an electronic apparatus for informing about the ground engaging operations, and/or even the status and/or the operation of the concerned part of the machine; for example, when the capsule is within a wear element, the measurements can be indicative of how the wear element is penetrating and/or scratching ground, and/or how worn off the wear element is. Accordingly, the measurements of the at least one sensor can be used for estimating a wear degree of the part or component of the machine having the capsule arranged therein, characteristics of the ground being engaged, an angle of attack with which the wear element is engaging the ground when the wear element receives the capsule, etc. Therefore, the measurements and/or any estimations made therefrom can be used for supervision of the part or component of the machine, predicting maintenance therefor, informing an operator of the earth moving machine or within a control center of the ground engaging operations, controlling the earth moving machine (e.g. adjustments of the angle of attack, adjustments of the trajectory of digging implements when engaging the ground, adjustments of the force applied by the earth moving machine, etc.) by feeding the data to a controller that automatically adjusts operation of the earth moving machine, etc.

In some embodiments, the at least one sensor comprises one or more of: a strain gauge, a pressure gauge, a relative displacement gauge, an optical fiber strip, a piezoelectric strip, a pressure sensor, and an accelerometer.

In some embodiments, the electronic device comprises a PCB. In some embodiments, the PCB is within the inner chamber. In some other embodiments, the PCB is outside of the inner chamber.

The PCB can be within the inner chamber for protection thereof, but it may also be outside in order to reduce the size of the capsule or for making possible to protect other elements of the electronic device, e.g. battery or batteries, sensing devices, etc. When the PCB is outside and the PCB includes a modem, the connection of the modem with the slot antenna can be, for instance, by way of an SMA cable or the like.

In some embodiments, the PCB is flexible, namely is a flex film PCB.

In some embodiments, the capsule has a central axis defining an axial direction, a front end, and a rear end opposite said front end in the axial direction, and comprises a container formed by the one or more walls not having the slot antenna arranged therein, the container extending in the axial direction from the front end and having the inner chamber; and the cover can be removably coupled to the container and is adapted to cover the rear part of the container. In some embodiments, the cover is adapted to form a flange when the cover is coupled to the container.

The cover where the slot antenna is formed is dimensioned such that it provides the capsule with a flange. The cover in form of a flange can simplify the removal of the cover so as to have access to the inside of the inner chamber. The cover can be removably coupled to the container by way of attaching means such as one or more threaded through holes and respective screw(s) or the like to be inserted into said hole or holes. It is noted that attaching means in the form of corresponding one or more threaded holes or thread through holes are also provided on the rear end of the container; the screw(s) is/are inserted into the hole(s) of both the cover and the container in order to couple them both.

In some cases, the rear part of the container is shaped such that it also provides the capsule with a flange, namely, each of the rear part of the container and the cover is shaped to form a flange. The provision of the flange on the rear part of the container can further simplify the coupling and decoupling processes since the attaching means can be arranged in a simpler way owing to the matching shapes of both flanges.

In some embodiments, one or more walls of the capsule (including or not, or being or not the at least one wall with the slot antenna arranged thereon) comprise one or more holes adapted for receiving one or more cables. In some embodiments, the electronic device comprises the one or more cables.

The electronic device within the capsule can be electrically coupled with components thereof (e.g. one or more sensors, a battery, etc.) or another electronic device that are outside of the capsule via a wired physical link in the form of one or more cables. To this end, walls of the capsule may be provided with through holes through which the cable(s) extend, thereby making possible to have one end of the cable(s) within the inner chamber for connection to one or more components of the electronic device, and another end of the cable(s) outside the capsule for connection to the outside component(s) or the another electronic device.

In some embodiments, the capsule further comprises a protector arranged adjacent to the at least one wall having the slot antenna arranged thereon. Preferably, the protector is arranged on the external surface of the at least one wall (i.e. the surface of the capsule most outwardly facing), notwithstanding it could also be arranged on the internal surface of the at least one wall (i.e. the surface of the capsule facing towards the inner chamber).

When the earth moving machine operates in environments or on terrains with extreme adverse conditions, the ingress of fines in contact with the capsule becomes greater, thereby increasing the pressure on the at least one wall. In such cases, a protector in the capsule provides an extra layer of protection. The protector is preferably a cover of an electrically non-conductive material but resistant against impacts and abrasion. The protector may include a protrusion with a shape and dimensions matching the shape and dimensions of the slot antenna, thereby cooperating the protrusion with the slot antenna to additionally protect the at least one wall and precluding the ingress of fines.

In some embodiments, the capsule further comprises a cap couplable to the at least one wall with the slot antenna or the cover, the cap comprising one or more protrusions for contacting walls of the cavity. In some of these embodiments, the one or more protrusions comprise a plurality of protrusions, the protrusions being spaced apart and parallel one to each other. In some of these embodiments, the cap is of a material such as, e.g. ethylene propylene diene monomer rubber (EPDM rubber), Hypalon, Viton, polyurethane, etc.; the material preferably features some flexibility.

The cap, owing to its material, introduces negligible propagation losses, if it does introduce any propagation losses at all. Since the cap covers the slot antenna, it prevents the ingress of particles to the inner chamber through the slot antenna, and with the protrusions it increases the friction between the capsule and the cavity so that the capsule remains reliably attached to the cavity.

In some embodiments, the cap is removably couplable to the cover.

In some embodiments, the cap comprises a recess that fits within the one or more protruding surfaces of the cover.

A second aspect of the disclosure relates to a device for an earth moving machine, the device comprising a capsule according to the first aspect of the disclosure, and a cavity having the capsule arranged therein.

The electronic device protected by the capsule generates and, preferably, processes measurements made at the device, for example the strains exerted on the device. The capsule can be secured to the cavity with attachment means known in the art, for example but without limitation, adhesive, material filling the space between the capsule and the cavity that is preferably flexible, epoxy, foam, etc.

In some embodiments, the device is a fitting or coupling system of wear elements.

The fitting or coupling system is a mechanical attachment between a female portion or cavity of the tooth and the male portion or nose of an adapter. In some embodiments, the cavity is in the adapter and the nose is in the tooth; this kind of couplings are called inverse coupling systems.

In some embodiments, the device is a wear element.

The arrangement of the capsule in one wear element or in another wear element influences both the measurements made, and the propagation of electromagnetic waves owing to the presence of other wear elements, soil and/or both dimensions and material of the wear element itself that interfere with the propagation of the waves.

In some embodiments, the wear element is an adapter, an intermediate adapter, or a cast/weld on nose. Hereafter the term adapter encompasses the adapter of two-part systems, the intermediate adapter of three-part systems, and also a nose welded or casted on the blade and it will be understood that the disclosure encompasses embodiments with all alternatives of systems of wear elements.

Adapters have a first attachment end intended for coupling the adapter with the tooth, and a second attachment end intended for coupling the adapter with the blade or another adapter (usually in the case of an intermediate adapter).

The arrangement of capsules in the adapter or in the cast/weld on nose may result in capsules more cost-effective than in an arrangement of capsules in the teeth. The adapters or the cast/weld on nose are replaced less often than teeth, therefore new capsules need be provided less often than when arranged in the teeth. This, in turn, also reduces the disposal of capsules and/or components thereof, even if they are recycled, but fewer capsules and electronic devices need be produced in the first place.

In some embodiments, the wear element is a tooth. Teeth have a wear end intended for wearing off with use, and an attachment end intended for coupling the tooth to an adapter.

In this sense, the attachment end has a cavity portion adapted for receiving coupling male portion, respectively, of an adapter, an intermediate adapter or cast/weld-on nose (depending on whether the system of wear elements is a two-part system one, e.g. tooth and adapter, a three-part system one, e.g. tooth, intermediate adapter, adapter, or a cast/weld-on nose). The female portion has a cavity for receiving the male portion of the other wear element of the system; the male portion is also known as nose.

In some embodiments, the cavity is arranged inside the female portion, of either the tooth or the second attachment end of the adapter. In some of these embodiments, the cavity is formed on a wall of the nose of the adapter.

The male portion received in the female portion precludes the capsule from moving or falling out from the wear element, in addition to attachment means used to secure the capsule to the cavity. When the cavity is formed on a wall that is closest to the wear end, strain measurements are made more proximate to the wear end, which might result in more precise sensing in some types of sensing, for example strain.

In some embodiments, the cavity is arranged on an external surface of the wear element.

In some embodiments, the cavity is arranged on a surface of the tooth that is at an end opposite the wear end.

The surface with the cavity formed therein is preferably in contact with the adapter whenever the tooth is coupled to the adapter. The adapter protects the capsule from falling out from the tooth. Further, this arrangement results in fewer interfering elements or material that negatively affect the propagation of the electromagnetic waves.

In some embodiments, the cavity is arranged in the male portion. In some of these embodiments, the cavity is on a surface at a front end of the male portion, that is to say, the end more inwardly introduced in the female portion of the receiving wear element. In some other embodiments, the cavity is adjacent to a through hole of the adapter or tooth for receiving a pin for mechanically fastening the adapter with the tooth; in these cases, the cavity is preferably parallel to the through hole.

In some embodiments, the cavity is arranged in the rear portion of the adapter. In some of these embodiments, the cavity is on a surface from which the male portion protrudes in the first attachment end. In some other embodiments, the cavity is on an external surface of the rear portion.

In some embodiments, an outermost surface of the at least one of the walls having the slot antenna arranged therein is flush with a surface of the wear element (i.e. the tooth or the adapter) where an opening of the cavity is formed.

The arrangement of the slot antenna flush with the surface where the opening of the cavity starts advantageously reduces the propagation losses of the electromagnetic waves radiated and/or captured by the slot antenna when compared with the propagation losses when the slot antenna is inside the cavity. Accordingly, the transmission power can be lower than in the latter case, or kept the same yet the power with which the waves will be received will be greater.

In some embodiments, the device is one of: a boom, a stick, a hydraulic cylinder such as e.g. a bucket cylinder, traction means such as e.g. a continuous track, or a cabin.

The capsule protects the electronic device or components thereof to be arranged in the device. Accordingly, in addition to protect the device and/or its components, the capsule enables the wireless transmission and/or reception of data.

Preferably, but not necessarily, the device includes a cavity for receiving and hosting the capsule at least when a location of the capsule on the device is such that the capsule might be exposed to soil and, thus, exposed to wear; the cavity reduces the exposure of the capsule. By way of example, when the device is traction means, the traction means are preferably provided with such a cavity adapted for the capsule.

When the device is a cabin, the capsule is preferably arranged on an underside of the cabin.

In some embodiments, the cavity adapted to receive the capsule has an opening that is L-shaped, that is to say, the opening is formed in the place of two walls that are not parallel. A third aspect of the disclosure relates to an earth moving machine comprising one or more capsules according to the first aspect of the disclosure, and/or one or more devices according to the second aspect of the disclosure or according to the eighth aspect of the disclosure, and/or one or more apparatuses according to the seventh aspect of the disclosure.

The earth moving machine can have one or several capsules introduced in parts thereof so that the electronic device(s) therein processes data and transmits it to one or more electronic apparatuses that are remote from the capsules, and/or so that the electronic device(s) therein processes data and the capsule or capsules are extractable more easily and reliably. When the parts are wear elements, the machine can have the capsules introduced in one, several or all wear elements of a same type, e.g. tooth, adapter, cast lip. Also, the capsules can be introduced in wear elements of different types, e.g. a capsule in one, some or each tooth and a capsule in one, some or each adapter.

In some embodiments, the earth moving machine further comprises both a wireless data receiver and at least one processing unit, which are remote from each of the one or more capsules or from each of the one or more devices, e.g. wear elements.

The earth moving machine can monitor a wear degree of the wear elements in accordance with wireless data signals sent from each capsule. The at least one processing unit is configured to digitally process the wireless data signals and determine a wear degree of the wear element associated with the wireless data signals.

In some embodiments, the at least one processing unit is configured to digitally process wireless data signals so as to one or more of: predict maintenance of the device, e.g. wear element, associated with the wireless data signals, inform an operator of an earth moving machine or within a control center of ground engaging operations of the earth moving machine, and control the earth moving machine (e.g. adjustments of the angle of attack, adjustments of the trajectory of digging implements when engaging the ground, adjustments of the force applied by the earth moving machine, etc.).

A fourth aspect of the disclosure relates to a process of manufacturing a capsule according to the first aspect of the disclosure, the process comprising the step of forming or adding a slot antenna in at least one wall of walls of the capsule.

The slot antenna can be formed such that it has one or more features as described with reference to embodiments of the first aspect of the disclosure. When the at least one wall is electrically conductive, like when comprising e.g. electrically conductive metallic material, the slot antenna is formed by either removing part of the material of the at least one wall or producing the at least one wall with a slot already formed therein. When the at least one wall is not electrically conductive, like when comprising e.g. plastic, a resin, etc., the slot antenna is formed by adding electrically conductive material to the at least one wall such that it comprises a slot therein.

In some embodiments, the process further comprises manufacturing the capsule with a potting process where the potting is carried out in a mold shaped according to the capsule, that is to say, all walls or all walls but the at least one wall with the slot antenna are formed with the potting process, and the at least one wall is manufactured such that it comprises or is made of electrically conductive material. In some of these embodiments, the mold is the cavity of a device according to the second aspect of the disclosure, that is to say, the mold is a cavity formed in one of: a wear element, a boom, a stick, a hydraulic cylinder, traction means, or a cabin. Further, in some of these embodiments, the method also comprises installing the manufactured capsule in the cavity of the device, and installing the device in an earth moving machine.

The capsule can be produced with a potting process using e.g. a resin like epoxy that provides the walls of the capsule. Then, the slot antenna is formed by adding in at least one of the walls of the capsule an electrically conductive component, i.e. a component with electrically conductive material, that includes the slot.

The potting can be conducted in a mold adapted to this end, or the device where the capsule will be introduced during usage of the earth moving machine can be used as mold as well.

In some embodiments, the potting process is carried out with the electronic device or components thereof introduced in the mold. In this way, the electronic device or said components are included in the capsule during the manufacturing process thereof.

In some embodiments, the process further comprises carrying out a potting process on the manufactured capsule so as to at least fill the slot of the slot antenna with dielectric material. In some of these embodiments, the potting process further fills the inner chamber of the capsule with the electronic device partially or completely introduced therein.

The capsule is manufactured with a different manufacturing process, and once manufactured, it is partially or completely filled with dielectric material by means of the potting process. The dielectric material prevents the ingress of particles within the inner chamber, and may also further protect the contents of the inner chamber when the material fills the inner chamber.

In some embodiments, the process further comprises manufacturing the walls of the capsule of an alloy using a mold, for instance by forging or microcasting. The alloy can be e.g. a material featuring a hardness between 20 and 50 Hrc, such as steel e.g. 30CrNiMo8 (AISI 4340), 42CrMo4 (AISI 4137, AISI 4137H), 34CrNiMo6 (AISI 4337), 36NiCrMo16, etc.

In some embodiments, the process further comprises providing attaching means; and coupling the at least one wall with one or more other walls of the capsule, in a removable manner, using the attaching means.

In some embodiments, the process further comprises steps of a process according to the fifth aspect below.

A fifth aspect of the disclosure relates to a process of manufacturing a device, e.g. wear element, according to the second aspect of the disclosure, the process comprising the steps of: forming, on the device, the cavity for receiving a capsule according to the first aspect of the disclosure; and introducing the capsule in the formed cavity.

The cavity of the device can be formed such that it has one or more features as described with reference to embodiments of the first and/or second aspect(s) of the disclosure.

A sixth aspect of the disclosure relates to a monitoring system for monitoring a wear degree of a device, e.g. wear element, according to the second aspect of the disclosure, the monitoring system comprising: one or more capsules according to the first aspect of the disclosure, each capsule of the one or more capsules being installed in a different device; a wireless data receiver for receiving wireless data signals from each capsule of the one or more capsules; and at least one processing unit configured to digitally process the wireless data signals so as to determine a wear degree of the device associated with the wireless data signals.

In some embodiments, the monitoring system further comprises a control center, the control center being remote from the one or more capsules and comprising both the wireless data receiver and the at least one processing unit.

In some embodiments, the monitoring system further comprises an earth moving machine, the one or more capsules being installed in a different device of the earth moving machine; the earth moving machine comprises both the wireless data receiver and the at least one processing unit, which are remote from each of the one or more capsules.

In some embodiments, the at least one processing unit is further configured to digitally process the wireless data signals so as to one or more of: predict maintenance of the device associated with the wireless data signals, inform an operator of an earth moving machine or within a control center of ground engaging operations of the earth moving machine, and control the earth moving machine (e.g. adjustments of the angle of attack, adjustments of the trajectory of digging implements when engaging the ground, adjustments of the force applied by the earth moving machine, etc.).

A seventh aspect of the disclosure relates to an apparatus for an earth moving machine, comprising: a sheet; fastening means for attaching the apparatus to a cavity of the earth moving machine; and at least one electronic device; the at least one electronic device comprising a printed circuit board mechanically coupled with the sheet, and a wireless communications module preferably mounted on the PCB; further, the sheet has a slot antenna arranged thereon, and the slot antenna is electrically coupled with the wireless communications module.

The apparatus provides the earth moving machine with data transmission and/or data reception capabilities, particularly in the device of the machine that hosts the apparatus. The sheet with the slot antenna can be arranged so as to cover an opening through which the cavity is accessed, thereby forming a protected volume owing to the sheet of the apparatus and the walls of the cavity. In addition, such arrangement is convenient to improve radioelectric performance since the device with the cavity typically comprises or is made of a metallic material, thereby forming a Faraday cage. So, when the sheet and, thus, the apparatus is farther away from the inside of the cavity, the electromagnetic waves that the slot antenna radiates can reach greater distances and the electromagnetic waves radiated by other devices can reach the slot antenna with greater power.

The electronic device enclosed in the aforesaid manner can communicate data, e.g. transmit data that it generates or processes, receive data that another electronic device outside of the cavity is providing to the electronic device, and likewise be protected from compacted material and fines that reach the device during operation of the machine. The mechanical coupling of the PCB, the electronic device and the sheet also protects both the PCB and the electronic device thanks to the mechanical properties of the sheet, which comprises or is made of a metallic material and can feature dimensions adapted to support impacts, friction, wear, extreme high or low temperatures, and stresses resulting from the ground engaging operations of the machine and/or the environment that the machine is in. In this sense, the sheet preferably comprises a material featuring a hardness between 20 and Hrc, such as steel e.g. 30CrNiMo8 (AISI 4340), 42CrMo4 (AISI 4137, AISI 4137H), 34CrNiMo6 (AISI 4337), 36NiCrMo16, etc.

The apparatus furthermore can be easily recyclable. Whenever the apparatus is to be decommissioned, the electronic device and the PCB can be separated from the remaining elements of the apparatus, and the apparatus without the electronic device and PCB can be recycled together with the device where it was installed, for example a wear element. That is to say, since the materials of the device and the sheet might have same or similar constitution, they both can be recycled at once in such event.

The use of a slot antenna is also convenient to avoid other types of antennas less suitable for harsh and stressful environments that earth moving machines are typically in; it is noted that, for example, chip antennas tend to stop working with ease due to failure of their electrical circuits, and monopoles tend to break when receiving impacts. In the slot antenna there are few electrical circuits, and the metallic material of the sheet not only protects the electronic device but also provides the antenna with rigidity to withstand the stresses during operation of the machine.

In some embodiments, the electronic device further comprises one or more terminals adapted for electrical connection with an electric power source.

The slot antenna and components of the electronic device can be electrically powered by a power source of the earth moving machine such as a power cell (e.g. a battery, a solar cell, etc.) electrically connectable to the device by way of the one or more terminals.

In some embodiments, the electronic device further comprises a battery.

The slot antenna and components of the electronic device can be powered by at least one battery of the electronic device.

In some embodiments, the fastening means comprise one or more of: a plurality of screws, a cap, adhesive, one or more welding joints, one or more mechanical clips, and a dielectric material. The dielectric material is preferably any material that can be used in a potting process for fixing the apparatus within the cavity.

In some embodiments, the at least one electronic device comprises at least one sensor. In some of these embodiments, a sensor of the at least one sensor is mounted on the PCB. In some of these embodiments, a sensor of the at least one sensor is arranged on a groove of at least one groove of the sheet. In some of these embodiments, a sensor of the at least one sensor is neither mounted on the PCB nor arranged on a groove of the sheet, but is electrically connected with the PCB.

When the at least one sensor comprises one or more sensors for measuring e.g. forces, strains, wear or presence, the sensor(s) may be attached to walls of the cavity where the apparatus is introduced for superior force or strain measurement, for example strain gauges, pressure gauges, accelerometers, etc. The sensor(s), notwithstanding, uses the slot antenna for communication of data by way of its electrical connection with the PCB, which in turn relies the data to a processor of the electronic device for processing of the data prior to transmitting processed measurement data, or to the wireless communications data for transmission of the sensed data.

In some embodiments, the apparatus is a capsule according to the first aspect of the disclosure. In this sense, the sheet is one of the walls of the capsule.

In some embodiments, a slot of the slot antenna is filled with a dielectric material.

An eighth aspect of the disclosure relates to a device for an earth moving machine comprising: a cavity; and an apparatus according to the seventh aspect of the disclosure, the apparatus being introduced in the cavity.

In some embodiments, the apparatus is introduced in the cavity such that the sheet of the apparatus covers an opening forming the cavity.

In some embodiments, the sheet of the apparatus is flush with a surface of the device where the opening of the cavity is formed.

In some embodiments, a chamber formed by walls of the cavity and the sheet is filled with a dielectric material, for instance by way of a potting process.

In some embodiments, the device is a wear element. In some of these embodiments, the wear element comprises one of: a tooth, an adapter, a wear cap, a shroud, and a pin system.

In some embodiments, the device is one of: digging implements, a boom, a stick, a hydraulic cylinder, traction means, and a cabin.

A ninth aspect of the disclosure relates to a process comprising: providing an apparatus according to the seventh aspect of the disclosure; arranging the apparatus in a cavity of a device of an earth moving machine; measuring with the at least one sensor; and transmitting measurements of the at least one sensor by radiating electromagnetic waves with the slot antenna.

In some embodiments, the device is a wear element. In some of these embodiments, the wear element comprises one of: a tooth, an adapter, a wear cap, a shroud, and a pin system.

The contact surfaces between teeth and adapters of a fitting system are particularly subjected to loads such due to friction, rubbing and crushing between teeth and adapters during operation of the earth moving machine. The apparatus provides protection to the electronic device thereof even when arranged in such wear elements.

In some embodiments, the device is one of: digging implements, a boom, a stick, a hydraulic cylinder, traction means, and a cabin.

In some embodiments, the process further comprises receiving data at the apparatus by capturing electromagnetic waves with the slot antenna.

In some embodiments, the transmission of measurements takes place at least while the earth moving machine engages ground.

In some embodiments, the step of arranging the apparatus in the cavity comprises fixing the apparatus in the cavity by way of fastening means, such as screws, a cap, adhesive, one or more welding joints, one or more mechanical clips, and a dielectric material.

When the apparatus is to be fixed with fastening means in the form of welding joints, the step further comprises welding one or more edges of the sheet to a surface where the opening of the cavity is formed and/or to walls of the cavity. When the apparatus is to be fixed with fastening means in the form of dielectric material, the step further comprises conducting a potting process whereby the dielectric material fills the cavity while the apparatus is introduced therein.

BRIEF DESCRIPTION OF THE DRAWINGS

To complete the description and in order to provide for a better understanding of the disclosure, a set of drawings is provided. Said drawings form an integral part of the description and illustrate embodiments of the disclosure, which should not be interpreted as restricting the scope of the disclosure, but just as examples of how the disclosure can be carried out. The drawings comprise the following figures.

DESCRIPTION OF WAYS OF CARRYING OUT THE DISCLOSURE

Figure 1:
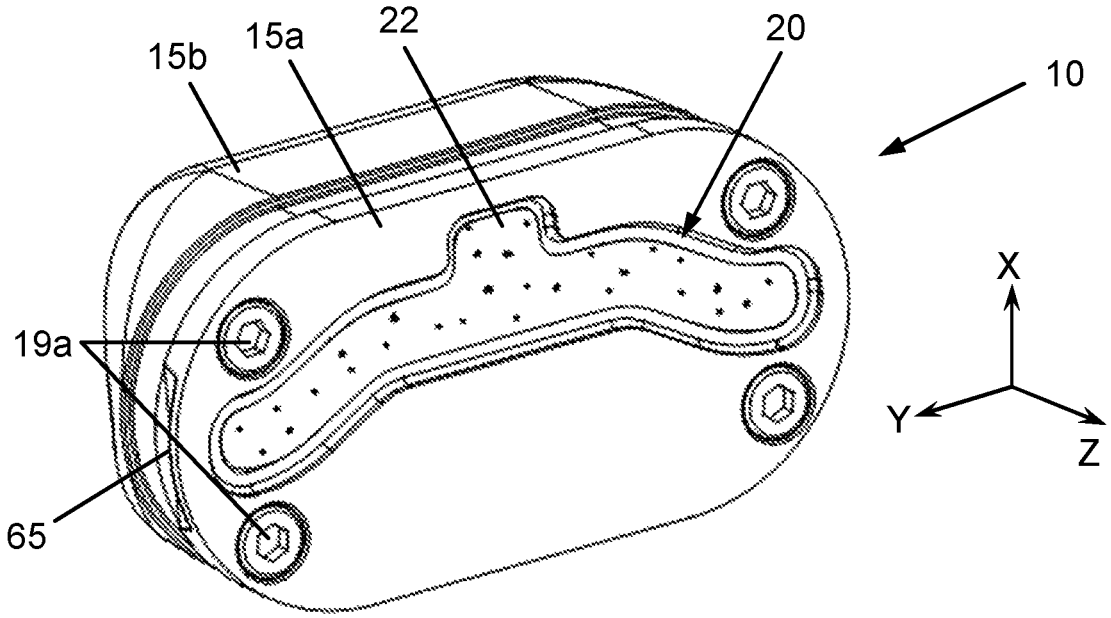
FIG. 1 shows a perspective view of a capsule according to embodiments.

FIG. 1 shows a perspective view of a capsule 10 according to embodiments.

The capsule 10 is adapted for introduction in a wear element of an earth moving machine, preferably in a cavity formed in a wear element. The capsule 10 has two or more walls 15*a*, 15*b*, at least one first wall 15*a* thereof has a slot antenna 20 formed therein. Either the totality of the at least one first wall 15*a* or at least a portion surrounding the slot of the slot antenna comprises or is made of an electrically conductive material such as metal like e.g. an alloy, thereby enabling the flow of current(s) for radiation and capturing of electromagnetic waves. The capsule 10, when all the walls 15*a*, 15*b* thereof are mechanically coupled, has an inner chamber (illustrated in e.g. FIG. 3 as inner chamber 16) adapted for housing and protecting an electronic device (illustrated in e.g. FIG. 3 as electronic device 30). In this embodiment, the slot of the slot antenna 20 is filled with dielectric material 22 so that e.g. soil does not get into the inner chamber.

The first wall 15*a* (or first walls 15*a*) has a maximum length in a particular longitudinal direction, in this case along the Y axis illustrated, a maximum width in a particular first transversal direction, in this case along the X axis illustrated, and a thickness in a second transversal direction, in this case along the Z axis illustrated. The slot antenna 20 preferably has a maximum length, which is the length measured along one axis that results in the maximum dimension of the slot antenna 20, in the longitudinal direction that is at least 60% and is less than or equal to 100% of the maximum length of the wall 15*a* (or walls 15*a*).

In this example, the first wall 15*a* is a cover removably couplable to a second wall or walls 15*b*, which in this case is a single second wall 15*b* shaped such that it forms a container, whereas, in some other embodiments, two or more second walls 15*b* are arranged and coupled so as to form the container with the inner chamber 16 therein. The first wall 15*a* mechanically couples to one or more of the second walls 15*b* by way of attaching means such as e.g. screws 19*a*. The attaching means of the first wall 15*a* also include respective threaded through holes, and the second wall(s) 15*b* include attaching means in the form of respective threaded holes or threaded through holes (not seen in FIG. 4).

The first wall 15*a* preferably comprises one or more protruding surfaces 65 extending parallel to the largest surface of the first wall 15*a*; the one or more protruding surfaces 65 preferably comprise or are of a metallic material, e.g. steel. The protruding surface(s) 65 aids in the extraction process of the capsule 10 by supporting a torque applied thereto for rotating the capsule 10.

For the sake of clarity, the X, Y and Z axes represented in FIG. 1 are also represented in the following Figures with the same orientation relative to the elements shown. It will be apparent that other X, Y and Z definitions are also possible without departing from the scope of the present disclosure.

Figure 2:
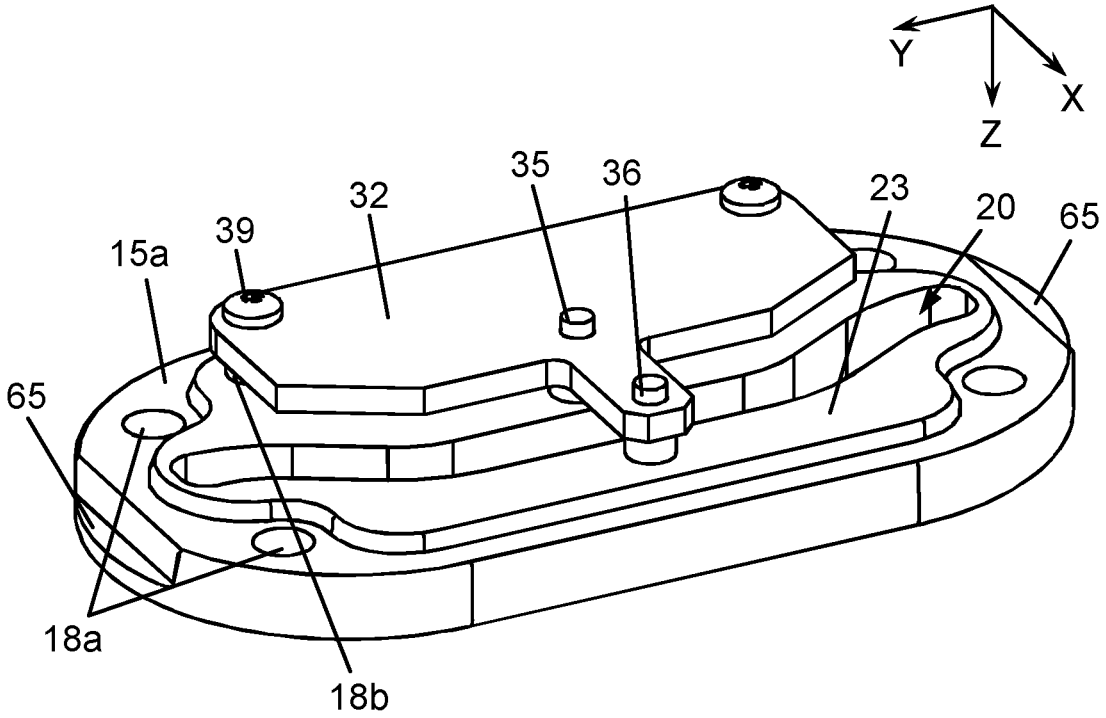
FIG. 2 shows a perspective view of a wall of a capsule according to embodiments, the wall including a slot antenna.

FIG. 2 shows a perspective view of a wall 15*a* of a capsule 10 according to embodiments, the wall 15*a* including a slot antenna 20 arranged therein. The side of the wall shown corresponds to an innermost side of the wall 15*a*, that is to say, it is the side of the wall 15*a* facing towards an inner chamber of the capsule. In some examples, the wall 15*a* shown is provided as wall 15*a* in the capsule 10 of FIG. 1.

In this exemplary embodiment, the wall 15*a* includes a projecting surface 23 that projects towards the inner chamber when the capsule is provided. The projecting surface 23 can be formed for improving the attachment of the wall 15*a* to other wall or walls of the capsule for closing the capsule; hence, the projecting surface 23 may result in a hermetic seal of the walls. The slot antenna 20 is also formed in this projecting surface 23.

The wall 15*a* includes attaching means in the form of threaded through holes 18*a* for removable coupling with other wall or walls of the capsule, and threaded holes 18*b* for attachment of a printed circuit board 32, i.e. PCB, of an electronic device. The electronic device includes attaching means as well by way of screws 39 that cooperate with the threaded holes 18*b* of the wall 15*a*. The PCB 32, which is arranged parallel to the wall 15*a* and adjacent thereto, also includes holes for receiving the screws 39. It will be apparent that other attaching means can be used instead of these threaded holes 18*a*, 18*b* and respective screws 39.

In this exemplary embodiment, the electronic device connects to the slot antenna 20 by way of the PCB 32, more particularly terminals 35, 36 of the PCB or the wall 15*a* for feeding the slot antenna 20. The terminals 35, 36 can be, for instance, spring contacts with connectors, soldered terminals as shown in FIG. 2, press-fit contact pads, etc. Likewise, in some embodiments, one or more cables connect the electronic device with the slot antenna 20.

Figure 3:
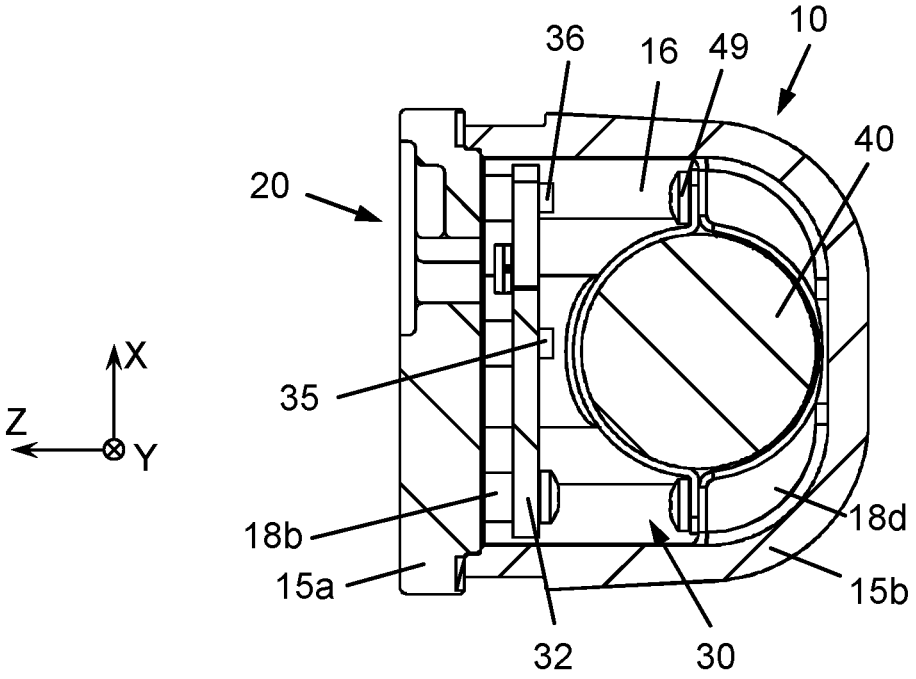
FIG. 3 shows a cross-section of a capsule according to embodiments.

FIG. 3 shows a cross-section of a capsule 10 according to embodiments. The plane intersecting the capsule 10 for the cross-section view is an XZ plane.

Figure 4:
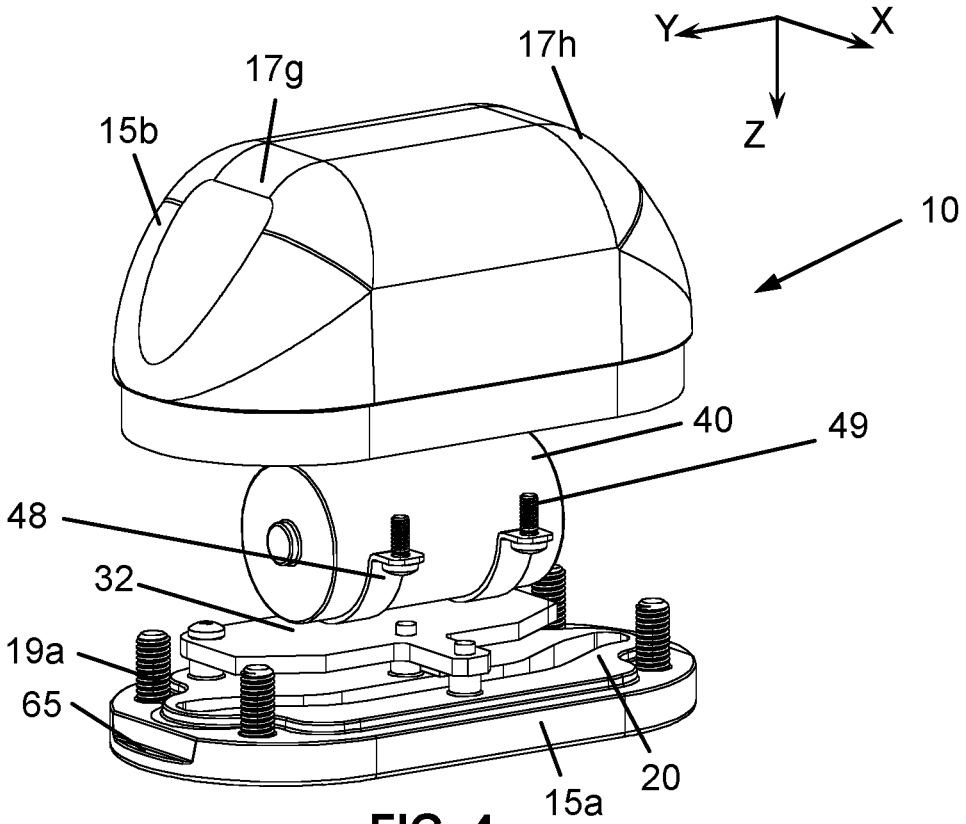
FIGS. 4-6 show perspective views of capsules according to embodiments.

As explained above and best seen in this Figure or in FIG. 4, the second wall 15*b* has a shape such that it forms a container.

As shown in this Figure, the inner chamber 16 houses and protects the electronic device 30, which includes the PCB 32 and a battery 40. The battery 40 is electrically connected to the PCB 32 for powering the electronic components thereof and the slot antenna 20. The battery 40 remains secured within the inner chamber 16 by way of securing means such as clamps (illustrated in e.g. FIG. 4 as clamps 48), screws 49 and thread holes 18*d* formed in the second wall 15*b*.

FIG. 4 shows a perspective view of a capsule 10 according to embodiments.

The attaching means of the wall 15*b* in the form of threaded holes receive screws 19*a* for coupling the first wall or cover 15*a* to the second wall or container 15*b*.

Although the battery 40 illustrated takes a significant amount of the volume within the inner chamber 16, it will be noted that other types of battery or batteries are also possible within the scope of the present disclosure. By way of example only, one or several button cells can be used.

Figure 5:
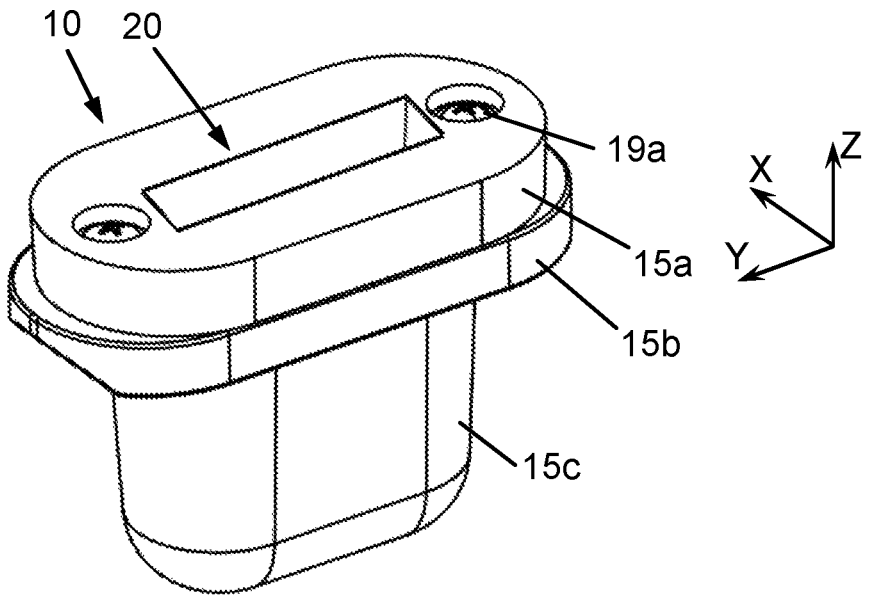

FIG. 5 shows a perspective view of a capsule 10 according to embodiments.

The capsule 10 includes first, second and third walls 15*a*-15*c*. The first wall 15*a* is removably coupled to the second wall 15*b* of the capsule 10, and the second wall 15*b* is preferably permanently coupled to the third wall 15*c*, the latter being shaped like a container for housing an electronic device in a protected manner. The second wall 15*b* is shaped such that it provides the third wall 15*c* with a flange, and the first wall 15*a* has a similar shape for forming a flange as well.

When the capsule 10 is provided with a flange, the removal of the first wall 15*a* may become easier so as to inspect the interior of the capsule 10, retrieve the contents or replace them, for maintenance purposes or for recycling, for example.

In comparison with the embodiments illustrated in FIGS. 1-4, the slot antenna 20 of the capsule 10 of FIG. 5 is a straight slot antenna with a single straight segment.

Figure 6:
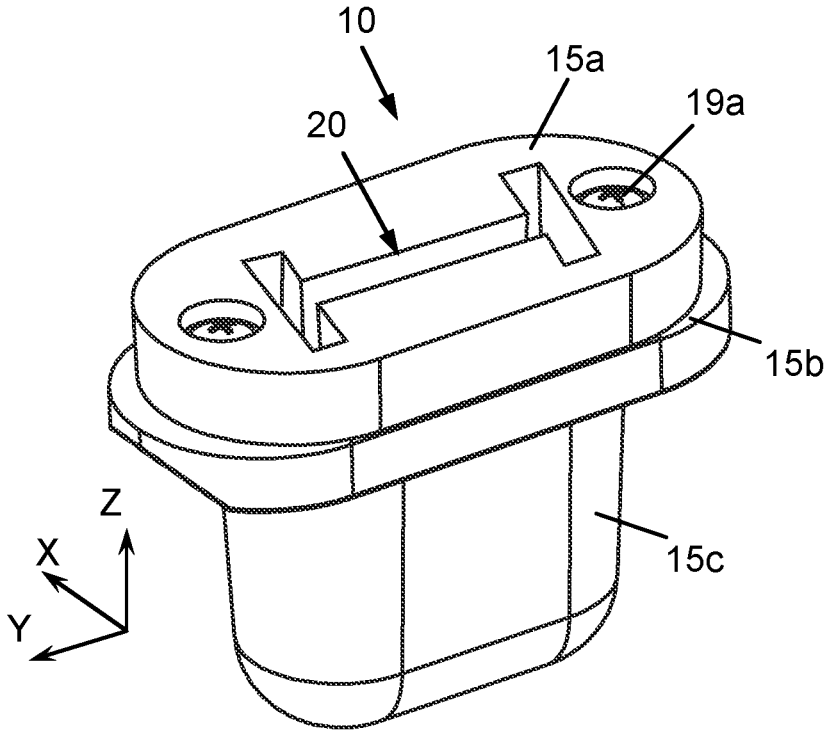

FIG. 6 shows a perspective view of a capsule 10 according to embodiments.

In comparison with the embodiment of FIG. 5, the slot antenna 20 of the capsule 10 of FIG. 6 is not straight and comprises a plurality of segments. In this case, there are three straight segments arranged such that a longitudinal axis of each segment forms an angle different from 0° with respect to the longitudinal axis of the segment or segments it is connected to.

Even though the slot antennas 20 of the embodiments of FIGS. 1-6 are arranged in an exterior wall of the capsule 10, it is noted that slot antennas 20 arranged in one or more interior walls of the capsule 10, or between an interior wall and an exterior wall, are also within the scope of the present disclosure. When the slot antenna is arranged in an interior wall, wall(s) between said interior wall and an opening of the cavity where the capsule is arranged is/are of materials that are non-electrically conductive so as not to produce interference or block the propagation of electromagnetic waves.

Figure 7:
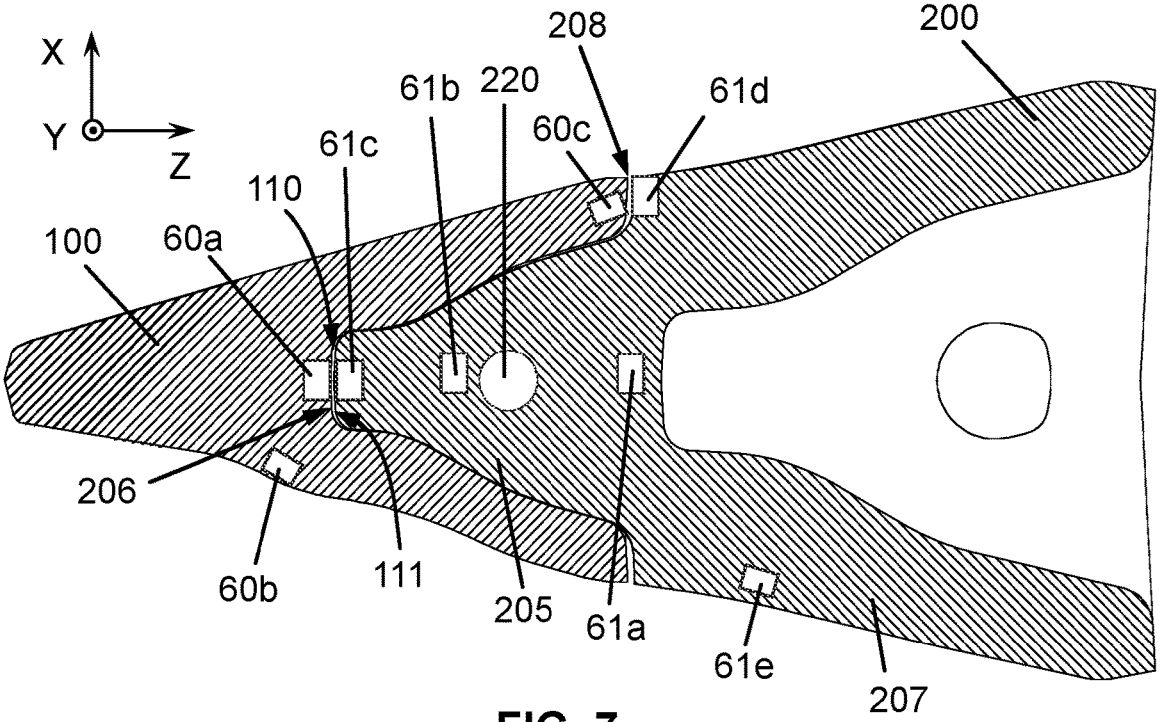
FIG. 7 shows a cross-section of wear elements illustrating positions where cavities for capsules are arrangeable according to embodiments.

FIG. 7 shows a cross-section of wear elements 100, 200 illustrating positions 60*a*-60*c* and 61*a*-61*e* where cavities for receiving capsules are arrangeable according to embodiments; for the sake of the illustration only, cavity positions 60*a*-60*c* and 61*a*-61*e* are shown as rectangular polygons for representing possible placement of cavities in accordance with embodiments. The plane intersecting the wear elements 100 and 200 for the cross-section view is an XZ plane. For the sake of clarity only, said plane is illustrated both in FIG. 9 with arrowed line 150, and in FIG. 10 with arrowed line 250.

A first wear element 100 is a tooth 100, and a second wear element 200 is an intermediate adapter 200, but in other embodiments the second wear element is an adapter when a two-part system of wear elements is provided.

The tooth 100 comprises a female portion 110 adapted to receive a male portion 205 of the intermediate adapter 200 when an earth moving machine is to carry out ground engaging operations.

A first position 60*a* for a capsule receiving cavity (illustrated in FIG. 8 as cavity 126) in the tooth 100 is inside the female portion 110. Preferably, the cavity is formed on a wall 111 of the female portion 110 that is closest to a wear end intended for wearing off with use. The wear end is the front-most part of the tooth 100 and is the end intended to engage ground during operation of the earth moving machine. The wear end is opposite a rear end through which the male portion 205 of the intermediate adapter 200 is received. Both the wear end and the rear end are illustrated in FIG. 8 as wear end 101 and rear end 102.

A second position 60*b* for a cavity (illustrated in FIG. 9 as cavity 127 with dashed lines for illustration purposes only) in the tooth 100 is an external surface (illustrated in FIG. 9 as external surface 106) that is intended to come into contact with ground during operation of the earth moving machine; namely, the external surface is surface intended to wear off with use.

Figure 8:
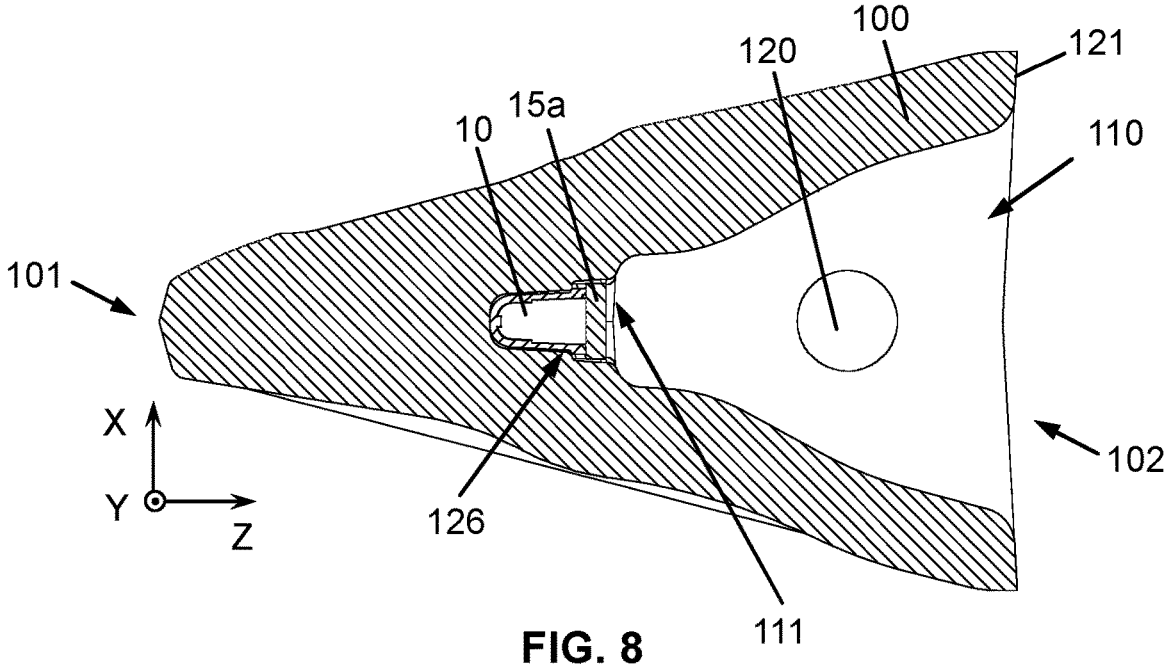
FIG. 8 shows a cross-section view of a tooth with a capsule according to embodiments.
Figure 9:
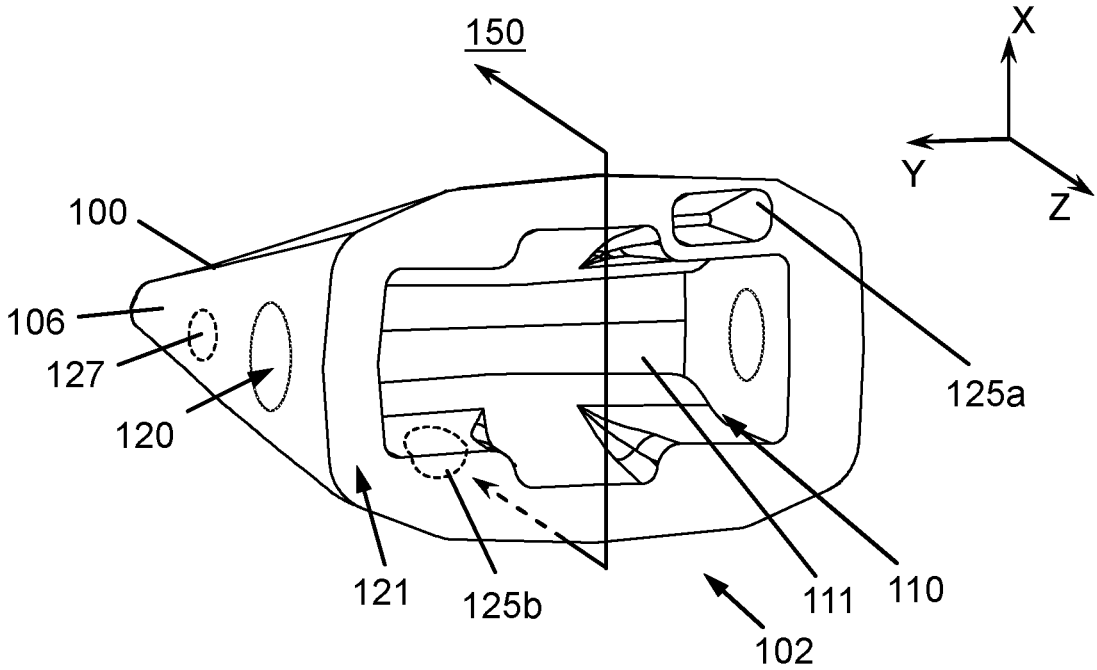
FIGS. 9-10 show perspective views of wear elements.

Another position 60*c* for a capsule receiving cavity (illustrated in FIG. 9 as cavities 125*a*, 125*b*, the latter with dashed lines for illustration purposes only) in the tooth 100 is a surface at the rear end of the tooth 100; with reference to FIGS. 8 and 9, said surface is surface 121. The cavity, which is shown in FIG. 9 as cavity 125*a* or cavity 125*b*, is on a side of the rear end that contacts the intermediate adapter 200 when mechanically coupled.

For mechanical coupling of both the tooth 100 and the intermediate adapter 200, the male portion 205 of the intermediate adapter introduces in the female portion 110 of the tooth 100 for receiving the intermediate. While inserted, attaching means in the form of e.g. a pin are introduced in both a through hole (shown with reference sign 120 in FIG. 8) of the tooth 100 and a through hole 220 of the intermediate adapter 200.

First and second positions 61*a*, 61*b* for a cavity (illustrated in FIG. 10 as cavities 225, 226, the latter with dashed lines for illustration purposes only) in the intermediate adapter 200 are in the male portion 205. The cavity can be adjacent to the through hole 220 for receiving the pin, and is preferably parallel thereto. The cavity can be arranged either in a portion of the male portion 205 closest to a front end thereof (i.e. the end to be introduced in the female portion 110 of the tooth 100, shown as cavity 226 in FIG. 10) or in a portion of the male portion 205 closest to a rear end thereof. It may be preferable to arrange the cavity according to the latter, i.e. as cavity 225 in the embodiment of FIG. 10, in order to minimize reductions in the mechanical resistance of the male portion 205 on its front end, which generally undergoes higher stress during operation of earth moving machine.

A third position 61*c* for a cavity (illustrated in FIG. 10 as cavity 227 with dashed lines for illustration purposes only) in the intermediate adapter 200 is the surface 206 of the male portion 205 that is at the frontmost part.

Another position 61*d* for a cavity (illustrated in FIG. 10 as cavity 228 with dashed lines for illustration purposes only) in the intermediate adapter 200 is the surface 208 of the rear portion 207. Typically said surface 208 is in contact with the rear surface of the tooth 100 thereby blocking the opening of the cavity, in this way the capsule cannot fall out from the cavity even if the attaching means securing the capsule within the cavity fail.

Yet another position 61*e* for a cavity (illustrated in FIG. 10 as cavity 229 with dashed lines for illustration purposes only) in the intermediate adapter 200 is an external surface (illustrated in FIG. 9 as external surface 106) of the rear portion 207 and which may wear off with use since it comes into contact with ground.

It will be noted that even though FIG. 7 shows a system of wear elements in which the tooth 100 comprises a female portion 110 in its attachment end, and the intermediate adapter 200 comprises a male portion 205 in its first attachment end (namely, the end for attachment to the tooth 100), in another embodiments the system of wear elements comprises same wear elements (or an adapter instead of the intermediate adapter 200) in which the tooth 100 comprises a male portion in its attachment end, and the intermediate adapter 200 comprises a female portion in its first attachment end. In those cases, the positions 60*a*, 61*a*-61*c* for cavities described can be swapped such that they are in the female portion of the intermediate adapter 200 and the male portion of the tooth 100, respectively.

FIG. 8 shows a cross-section view of a wear element 100, particularly a tooth 100, with a capsule 10 according to embodiments. The plane intersecting the tooth 100 and 200 for the cross-section view is an XZ plane like the plane corresponding to arrowed line 150 in FIG. 9.

A cavity 126 is formed inside a female portion 110, in a front-most wall 111 of the female portion 110, that is to say, in a wall 111 closest to the wear end 101; it is noted that, in other embodiments, the cavity 126 is formed in other wall within the female portion 110. As it can be observed, the female portion 110 is shaped and dimensioned for receiving a male portion of an intermediate, whereas the cavity 126 is shaped and dimensioned for receiving the capsule 10. The through hole 120 of the tooth 100 is to be aligned with the through hole of the intermediate adapter when the latter is introduced in the tooth, thereby making possible to mechanically couple both wear elements with a pin.

Preferably, the cavity 126 is shaped such that a cover 15*a* of the capsule 10 is closest to the rear end 102, particularly when said cover 15*a* provides the capsule 10 with a flange. Upon removing attaching means of the cover 15*a*, either while the capsule 10 is within the tooth 100 or once the capsule 10 has been extracted therefrom, personnel can inspect the device(s) and components thereof housed in the capsule 10. It may also be preferable to dimension the cavity 126 and the capsule 10 such that, when the capsule 10 is within the cavity 126 and the slot antenna is formed on e.g. the cover 15*a*, the slot antenna is flush with the wall 111. It is understood that the slot antenna is flush when an outermost face of the slot antenna is coplanar or almost coplanar with at least a portion of the wall where the opening of the capsule receiving cavity 126 is formed; the face and the wall are almost coplanar when there is a difference in depth smaller than 20 mm, and is preferably less than or equal to 10 mm and/or 5 mm. When not arranged flush with the wall 111, the capsule and the slot antenna are preferably more inwards in the cavity for increasing the protection of both.

FIG. 9 shows a perspective view of a wear element 100, particularly a tooth 100.

In this embodiment, the tooth 100 does not include the capsule receiving cavity of the embodiment of FIG. 9, but includes a cavity 125*a* formed in surface 121 that is on the rear end 102 of the tooth 100. As seen in FIG. 7, whenever the intermediate adapter 200 gets coupled to the tooth 100, a surface thereof adjacent to the male portion 205 (or female portion when the first attachment end of the intermediate adapter or adapter includes it) becomes in contact with the surface 121 thereby securing the capsule aside from the securing of the attachment means thereof.

In FIG. 9 is also shown, with dashed lines, another possible cavity 125*b* formed in the surface 121 but such that the opening of the cavity is L-shaped. A first portion of the opening is on the surface 121, whereas a second portion of the opening is on a surface within the female portion 110. When the intermediate adapter attaches to the tooth, the two portions of the opening are blocked by the intermediate.

Also, another possible cavity 127 is shown with dashed formed in the external surface 106 of the tooth 100.

Figure 10:
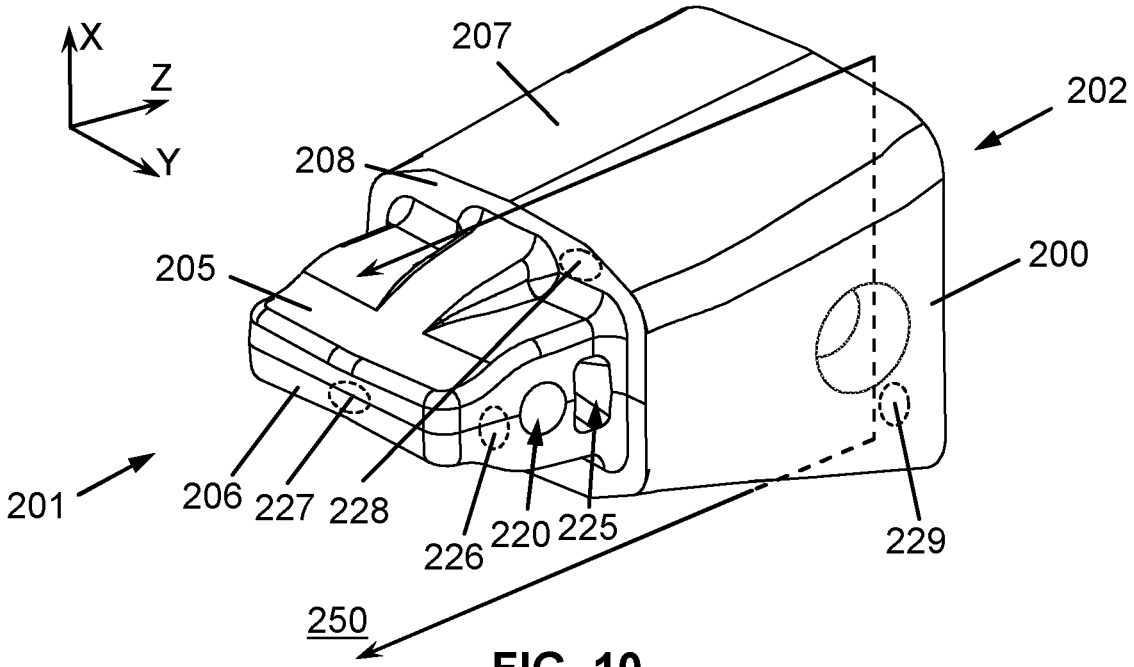

FIG. 10 shows a perspective view of a wear element 200, particularly an intermediate adapter 200, but could equally be an adapter when the system of wear elements is a two-part system.

The intermediate adapter 200 has a front end 201 with the male portion 205 and a rear end 202 with a rear portion 207 that provides a second attachment end for attachment with a blade of the earth moving machine, through an adapter, a weld-on nose, or a cast nose.

A cavity 225 is arranged in the male portion 205 and next to the through hole 220 for the pin. In this case, the cavity 225 is, relative to the through hole 220, closer to the rear end 202 than to the front end 201. By contrast, in other embodiments, a cavity 226 is arranged closer to the front end 201 than to the rear end 202 in comparison with the position of the through hole 220. This part of the male portion 205, which is either proximate to or on the neutral plane, is subjected to less stress and deformation than other parts of the adapter 200, and it also subjected to less lateral hits or of lower intensity than other parts of the adapter 200 too. Moreover, said part of the male portion 205 is less prone to material compaction, which under normal circumstances takes place in surfaces between the teeth and the adapters and where the egress of said material is more difficult, like in the front-most part of the adapter 200. These characteristics make the cavities 225 and 226 next to the through hole 220 convenient for the arrangement of a capsule, not only for increasing the useful life thereof and of the electronic device it protects, but also for both reduced losses in the transmission and reception of wireless signals, and the provision of data about the terrain during operation of the machine resulting from the measurements of the electronic device.

Another possible cavities are shown in the same Figure for illustrative purposes only. By way of example, cavity 227 is shown formed in the surface 206 at the front end 201, i.e. the tooth attaching end. By way of another example, cavity 228 is formed in the surface 208 of the rear portion 207 from which the male portion 205 protrudes. And like in a tooth, another possible cavity 229 is formed in an external surface 229 of the rear portion 207; this surface 229 can contact ground during ground engaging operations.

Figure 11:
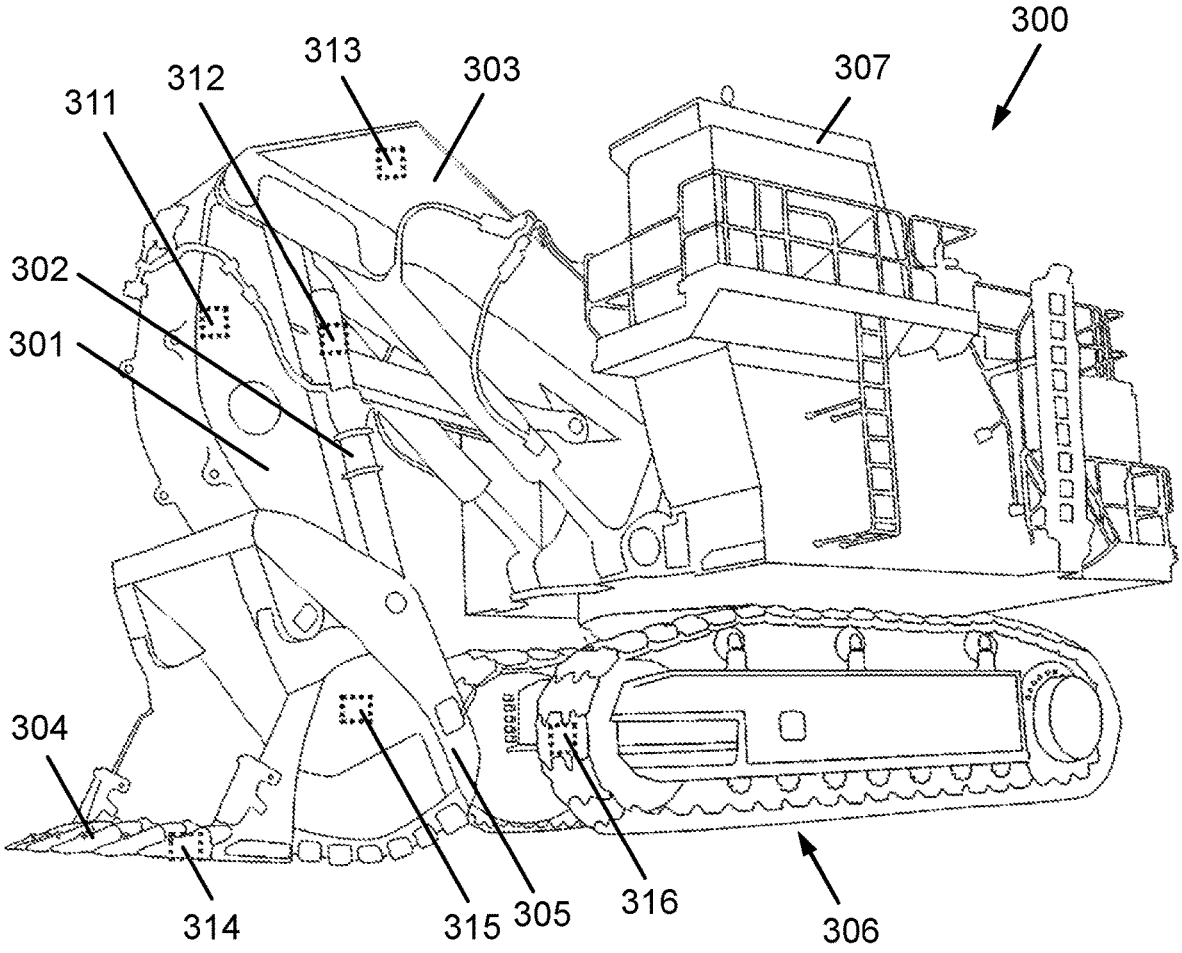
FIG. 11 shows an earth moving machine illustrating devices thereof with positions where capsules can be arranged according to embodiments.

FIG. 11 shows an earth moving machine 300 illustrating devices thereof with positions where capsules can be arranged according to embodiments.

The machine 300 comprises a stick 301, a hydraulic cylinder 302, a boom 303, wear elements 304, digging implements 305, traction means 306 and a cabin 307. A capsule according to the present disclosure is arrangeable in each of these devices 301-307 in different embodiments.

By way of example, capsules can be arranged in a position 311 of the stick 301 that is, for instance, not subject to regular contact with ground during ground-engaging operations, for example in an upper half of the stick 301, and in a similar position 312 along the length of the hydraulic cylinder 302. The capsules can be arranged in a position 313 of the boom 303 that is preferably closest to a joint with the stick 301. The capsules can be arranged in different positions 314 of wear elements 304 as described, for instance, with reference to FIGS. 7-10, and in side faces or the inside 315 of the digging implements. The capsules can be arranged in tracks 316 of continuous tracks of traction means 306, or below the cabin 307.

When capsules are arranged in positions prone to wear, earth compaction or hits, preferably the capsules are arranged in cavities formed in the devices 301-307 in these locations. Otherwise, the capsules can also be arranged directly on the surface of the devices 301-307, namely not in any cavities, in which case the capsules are attached to the devices 301-307 with attaching means like bolts, welding, etc.

FIGS. 12A-12E diagrammatically show cross-sections of capsules 10*a*-10*c* according to embodiments.

Figure 12A:
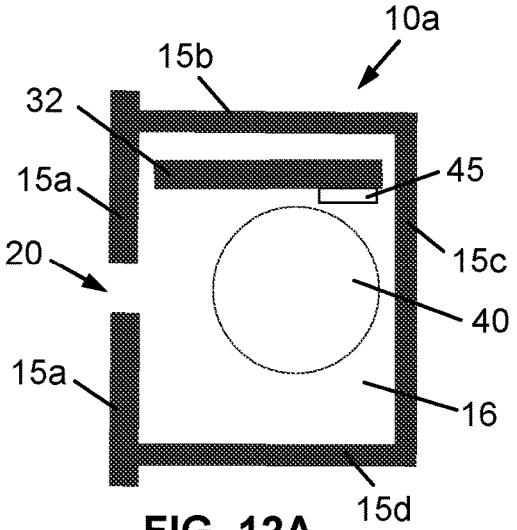
FIGS. 12A-12E diagrammatically show cross-sections of capsules according to embodiments.

In FIG. 12A, the slot antenna 20 of the capsule 10*a* is arranged at the middle in relation to the X axis illustrated. A PCB 32 of the electronic device 30 is arranged oriented along an axial direction (the Z axis illustrated) and is parallel to the slot antenna 20. More particularly, a length of the PCB 32 (along the Z axis illustrated) is parallel to the slot antenna 20 (along the Z axis illustrated). Notwithstanding, the PCB 32 is offset from the position of the slot antenna 20 (along the X axis illustrated). The electronic device 30 preferably also includes at least one sensor 45 soldered on the PCB 32. The at least one sensor 45 may also be remote from the PCB 32 like in FIGS. 12B-12D in which the at least one sensor 45 is attached to a wall of the inner chamber 16, or even remote from the capsule; in these cases, the electronic device 30 comprises an electrical connection and/or a wireless communications link between the at least one sensor 45 and the PCB 32 for sending the measurements, and through the same electrical connection or another one, the battery 40 energizes the at least one sensor if not provided with its own battery.

Figure 12B:
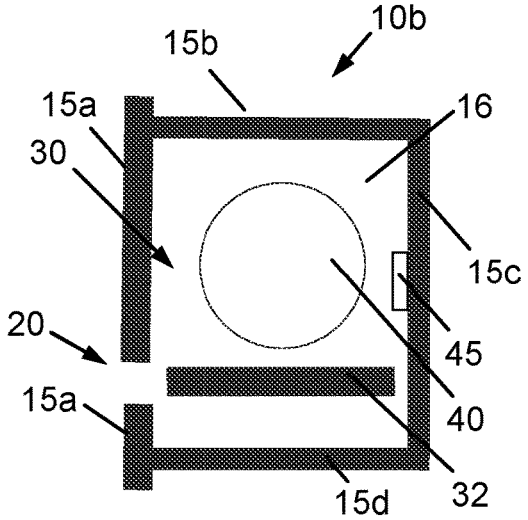

In FIG. 12B, the slot antenna 20 of the capsule 10*b* is arranged offset from the middle in relation to the X axis illustrated. In this embodiment, the PCB is also oriented along the axial direction, and not only it is parallel to the slot antenna 20 but is also aligned with the slot antenna 20.

Figure 12C:
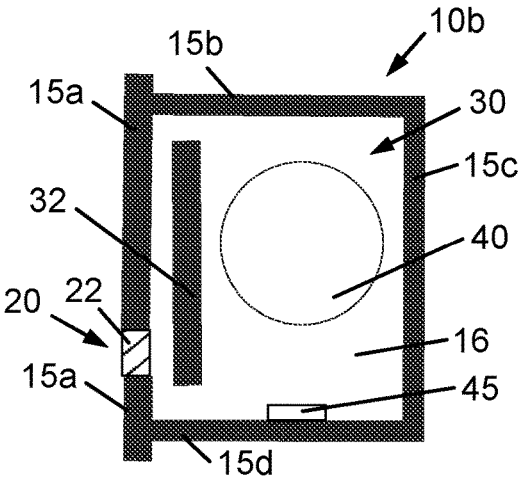

In FIG. 12C, the slot antenna 20 is arranged like in the embodiment of FIG. 11B. The PCB 32 is perpendicular to the axial direction and is attached to the wall 15*a* such that at least a portion of the slot antenna 20 is covered by the PCB 32. Such arrangement may ease the electrical connection of the PCB 32 to the slot antenna 20.

The capsules 10 of FIGS. 12A-12C each include four walls 15*a*-15*d*, a first wall 15*a* where the slot antenna 20 is provided, and second, third and fourth walls 15*b*-15*d* mechanically coupled (preferably in a permanent manner, for example welded together) to form a container. The first wall 15*a* can be removably coupled to the second and fourth walls 15*d*. In these examples, the wall 15*a* containing the slot antenna 20 comprises, either in an area surrounding the slot or in an entirety of the wall, electrically conductive material so that the slot antenna 20 is capable of radiating and capturing electromagnetic waves. When not an entirety of the wall 15*a* comprises the electrically conductive material, one or more portions thereof may comprise other material like e.g. resin. The remaining walls, i.e. walls may comprise electrically conductive or non-conductive material.

In this example, a couplable lid or cap of dielectric material 22 is arranged in the slot of the slot antenna 20. The lid or cap can be attached to the walls delimiting the slot with e.g. adhesive or attaching means.

Figure 12D:
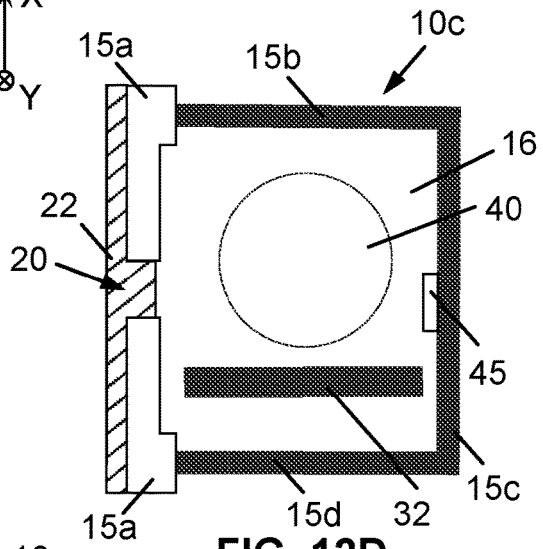

In FIG. 12D, the capsule 10*c* comprises at least one wall 15*a* where the slot antenna is provided that is of electrically conductive material, and the at least one wall 15*a* is coupled with other walls 15*b*-15*d* of a different material, either electrically conductive or non-conductive. In this example, a couplable lid or cap of dielectric material 22 is provided on the at least one wall 15*a* where the slot antenna 20 is arranged. The lid or cap can be attached to the wall 15*a* of the capsule with e.g. adhesive or attaching means.

Figure 12E:
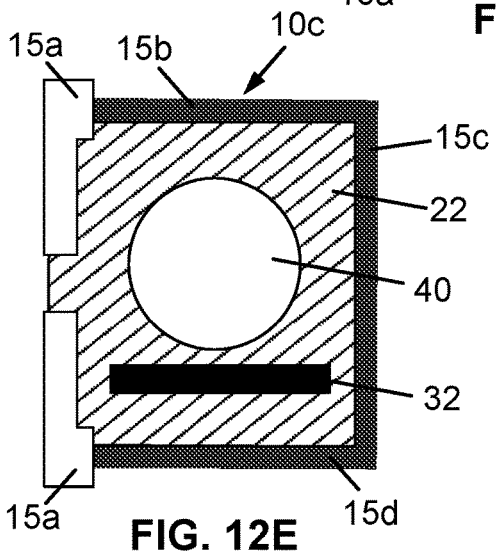
Figure 13A:
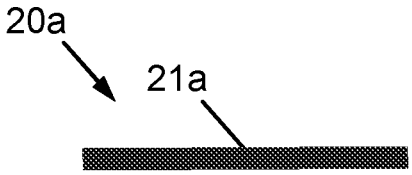
FIGS. 13A-13E diagrammatically show geometries of slot antennas for capsules according to embodiments.
Figure 13B:
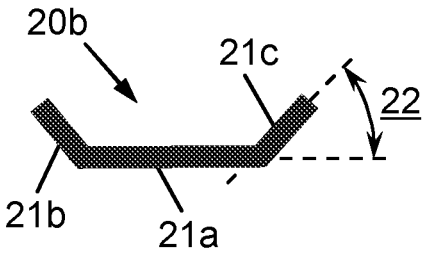
Figure 13C:
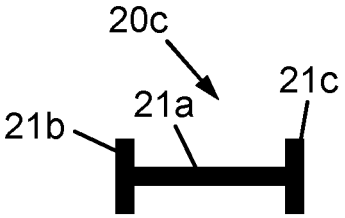
Figure 13D:
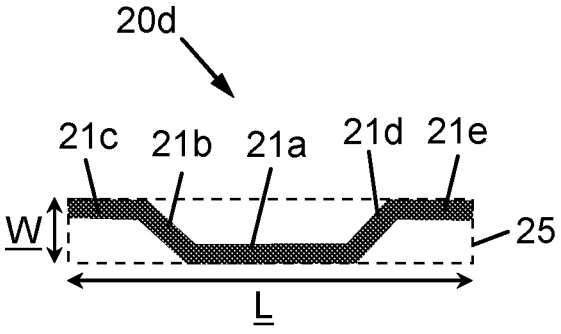
Figure 13E:
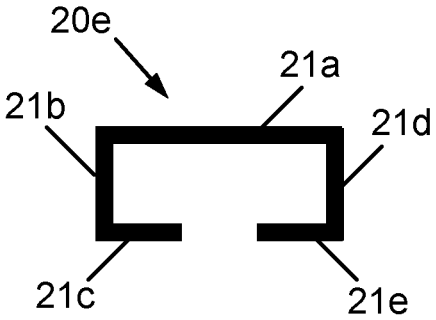

In FIG. 12E, the capsule 10*c* comprises the same walls 15*a*-15*d* and slot antenna, but instead of a couplable lid or cap, the dielectric material 22 fills the entirety of the inner chamber 16 in addition to the slot of the slot antenna 20.

In similar embodiments, the dielectric material 22 forms the walls (e.g. the walls 15*b*-15*d* not including the slot antenna 20, or all the walls 15*a*-15*d*) and also fills the inner chamber 16, thus the walls and the inner chamber filled are made of a single piece; in this sense, the outer faces of the filling are walls of the capsule. Such capsules can be produced, for instance, with a potting process.

In other embodiments, the PCB 32, a sensor attached or connected to the PCB 32 and/or the battery 40 may be outside the inner chamber 16, for instance in another cavity formed to receive said component(s), or can be attached to one of the walls 15*a*-15*d* of the capsule 10 from the outside. In these embodiments, the electrical connection between component(s) outside the inner chamber 16 and component(s) within the inner chamber 16 can be made by way of e.g. one or more cables, flexible printed circuit boards, etc.

It is to be noted that the slot antenna 20 of embodiments such as those described with reference to FIGS. 12A-12E can be formed in the space existing between two or more adjacent walls. By way of example, the top and bottom walls 15*a* illustrated in FIGS. 12A-12E can each be a separate wall and arranged such that the slot is present between the two walls 15*a*, thereby forming a slot antenna 20 when at least the portion surrounding the slot is electrically conductive. This means the slot antenna 20 thanks to two or more walls 15*a* and the way they are coupled together.

FIGS. 13A-13E diagrammatically show geometries of slot antennas 20*a*-20*e* for capsules according to embodiments. The slot antennas 20*a*-20*e* can be formed in one or more walls of the capsules.

A first slot antenna 20*a* is a straight slot antenna owing to a single segment 21*a* thereof, which furthermore is straight in this example. The capsule of FIG. 5 includes a slot antenna like the first slot antenna 20*a*.

A second slot antenna 20*b* comprises three segments 21*a*-21*c* arranged such that a middle-most first segment 21*a* is connected, on a first end thereof, to a second segment 21*b* and, on a second end thereof, to a third segment 21*c*. With regards to the first and third segments 21*a*, 21*c*, longitudinal axes have been represented with dashed lines for illustrative purposes only. Likewise, an angle 22 formed between said longitudinal axes is represented. A similar representation could be made in respect of the first and second segments 21*a*, 21*b*. The smallest or the largest angle 22 could be measured too, but it is clear that whichever the angle 22 that is measured, the longitudinal axes form an angle different from 0°.

A third slot antenna 20*c* comprises three segments 21*a*-21*c* arranged such that a middle-most first segment 21*a* is connected, on respective ends thereof, to second and third segments 21*b*, 21*c* such that angles of 90° are formed. As shown in this example, the segments 21*a*-21*c* do not necessarily have to be connected at ends thereof, but they can be connected at some point along the length of the segments. The capsule of FIG. 6 includes a slot antenna like the third slot antenna 20*c*.

A fourth slot antenna 20*d* comprises five segments 21*a*-21*e*. A middle-most first segment 21*a* is connected, on a first end thereof, to a second segment 21*b*, in turn connected to a third segment 21*c* that is parallel to the first segment 21*a*. The middle-most first 21*a* is connected, on a second end thereof, to a fourth segment 21*d*, which in turn is connected to a fifth segment 21*e* that is parallel to the first segment 21*a*.

Another slot antenna 20*e* comprises a plurality of segments 21*a*-21*e* including five segments. The arrangement of the segments 21*a*-21*e* is somewhat similar to the arrangement of the fourth slot antenna 20*d* but, in this example, the third and fifth segments 21*c*, 21*e* extend inwardly. In this way, the length of the wall or walls where the slot antenna 20*e* is arranged is reused by the slot antenna 20*e* to lengthen the radioelectric length thereof, that is to say, to lengthen the path that currents will follow for radiating and/or capturing electromagnetic waves. In this case, said path is the concatenation of all segments 21*a*-21*e*, thus the length thereof is the sum of the lengths of the segments 21*a*-21*e*.

The different arrangements of the second, third, fourth and fifth slot antennas 20*b*-20*e* are intended to increase an effective length of the slot antenna 20 based on, for example, a size of the wall of the capsule in which they are formed. In this way, the frequency of operation of the slot antenna 20 can be reduced with a wall featuring a minor length.

Although the exemplary slot antennas 20*a*-20*e* of FIGS. 13A-13E have straight segments, in other embodiments similar or different slot antenna geometries can be arranged in which one, some or all segments thereof are curvilinear. Likewise, it is not necessary that the slot antennas 20*a*-20*e* feature symmetry and can even have an irregular geometry.

The slot antennas may also feature a meander-like geometry intended to make use of a greater portion of the surface of the wall or walls where it is arranged to increase the radioelectric length.

In some embodiments, the maximum dimension of the slot antenna 20 (of embodiments such as, but without limitation, any one of those of FIGS. 1 to 6, 12A to 12E and 13A to 13E) is at least 40 mm. In some embodiments, the maximum dimension of the slot antenna 20 (of embodiments such as, but without limitation, any one of those of FIGS. 1 to 6, 12A to 12E and 13A to 13E) is equal to or less than 115 mm. By maximum dimension it is meant the greatest edge of a rectangle (like the rectangle 25 shown with dashed lines in FIG. 13D, but it is readily apparent that a similar rectangle 25 can be drawn for any other slot antenna) enclosing a shape of the slot 20 with sides of the rectangle being tangent to the slot 20; with reference to the rectangle 25 of FIG. 13D, the maximum dimension corresponds to the length of the edge indicated with letter L, which is greater than the length of the edge indicated with letter W.

The maximum dimension of the slot antenna affects the radioelectric performance thereof for different frequencies, thereby increasing or reducing the gain at each frequency. In some embodiments, the maximum width of the at least one of the walls where the slot antenna 20 (of embodiments such as, but without limitation, any one of those of FIGS. 1 to 6, 12A to 12E and 13A to 13E) is arranged has a width of at least 20 mm. In some embodiments, the width is at most 60 mm. A rectangle enclosing the at least one wall may be drawn like the rectangle 25 for a slot antenna, but with sides of the rectangle tangent to the at least one wall; the maximum width in these cases is the length of the edge that is shortest out of the edges of the rectangle, that is to say, that corresponding to the length W shown in FIG. 13D but with a rectangle for the at least one wall. The rectangle is thus drawn with respect to a particular longitudinal direction and a first transversal direction of the at least one wall.

The width of the wall or walls affect the gain of the slot antenna; the width is measured along the direction of the two perpendicular directions that closes the capsule and has a shortest length between said two perpendicular directions.

In some embodiments, the at least one of the walls where the slot antenna 20 (of embodiments such as, but without limitation, any one of those of FIGS. 1 to 6, 12A to 12E and 13A to 13E) has a thickness of at least 1.0 mm and, preferably, is less than or equal to 20.0 mm. In some embodiments, the thickness is between 2.0 mm and 8.0 mm, the endpoints being included in the range. The thickness is the third dimension of the wall that is not included in the rectangle enclosing the at least one wall, namely the thickness in in a second transversal direction.

The thickness of the wall or walls can be selected based upon the expected strains or wear that the capsule is to undergo during ground engaging operations based on the location of the capsule on the earth moving machine. The thickness is measured along the direction towards the inside of the inner chamber and, thus, is not any one of the two perpendicular directions that closes the capsule, i.e. those of the maximum length and maximum width. It has been found out that thicknesses within the aforesaid range has little or no influence on the gain of the slot antenna.

Figure 14A:
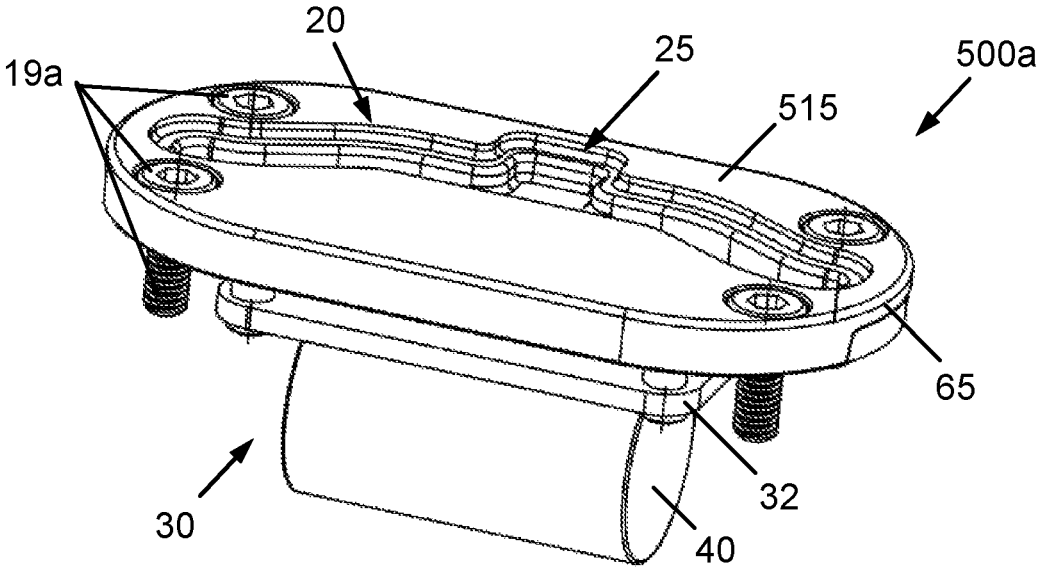
FIGS. 14A-14B show different views of an apparatus according to embodiments.
Figure 14B:
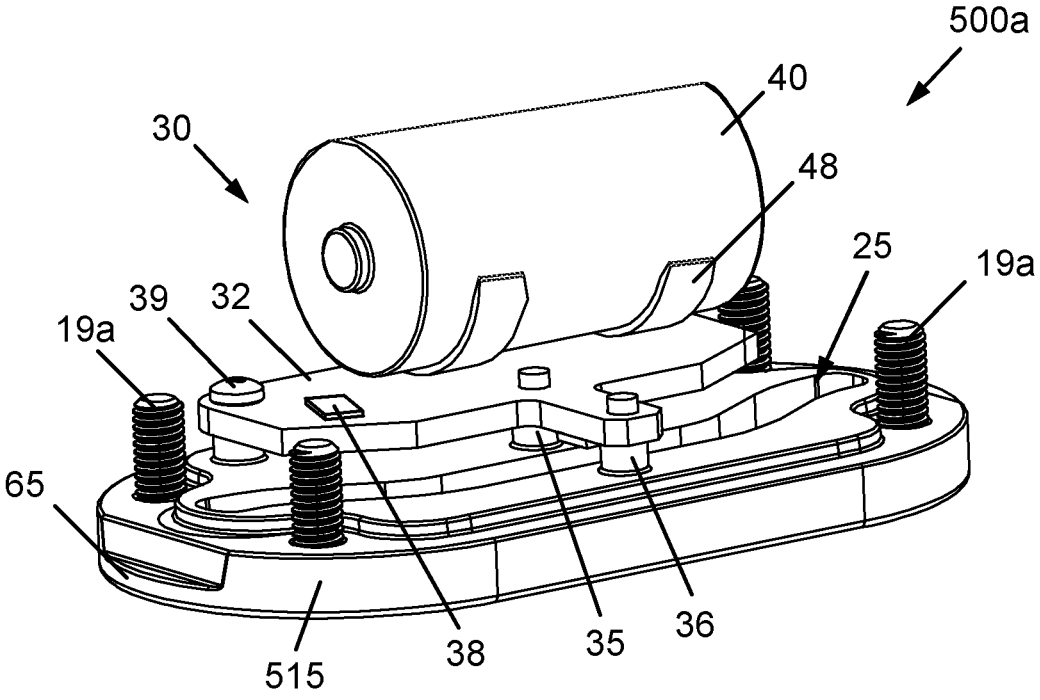

FIGS. 14A-14B show different views of an apparatus 500*a* according to embodiments.

The apparatus 500*a* comprises a sheet 515 having a slot antenna 20 arranged therein. Moreover, in preferred embodiments like in the ones of these Figures, the sheet 515 also comprises at least one groove 25 for installing a sensor 90 of an electronic device 30, such as a Hall-effect sensor, and protruding surfaces 65 that might ease the extraction of the apparatus 500*a* when it is introduced in a device (like in FIG. 15B) by means of an extraction tool. In other embodiments, only one of these additional features, i.e. groove(s) 25 and protruding surface(s) 65, or none of them is present.

An extraction tool can be partially introduced in a portion of the apparatus 500*a* that is recessed with respect to the protruding surface 65. The extraction tool is brought about to contact the protruding surface 65. Then, the extraction tool is rotated towards an opening of a cavity where the apparatus 500*a* is inserted, or in other words, towards an extraction direction. The extraction tool thus applies torque on the protruding surface 65 and, as a result, the apparatus 500*a* tends to rotate within the cavity. The extraction tool is preferably a pointy device like e.g. a punch, a screwdriver, etc.

The apparatus 500*a* further comprises the electronic device 30 that includes a printed circuit board 32 and a battery 40. The PCB 32 is mechanically coupled with the sheet 515 in order to better withstand e.g. impacts and stresses. To this end, attaching means like screws 39 can attach the PCB 32 to the sheet 515, which may include attaching means of its own to cooperate with those of the PCB 32, e.g. threaded holes in this case. The battery 40 is preferably likewise mechanically coupled with the PCB 32, for instance by way of clamps 48.

Terminals 35, 36 are arranged in the sheet 515, the PCB 32, or between them to electrically connect the slot antenna 20 with the PCB 32 for feeding of the former. A wireless communications module 38 mounted on the PCB 32 controls operation of the slot antenna 20 so that it may radiate and/or capture electromagnetic waves.

As aforementioned, the electronic device 30 can comprise a sensor 90 to be arranged in a groove 25, and/or a sensor not arranged in any groove, for instance mounted on the PCB 32.

In other embodiments such as the ones of FIGS. 15A to 18, the apparatus 500*a* can be even more compact when the battery 40 of the electronic device 30 is one or a plurality of button cells.

Figure 15A:
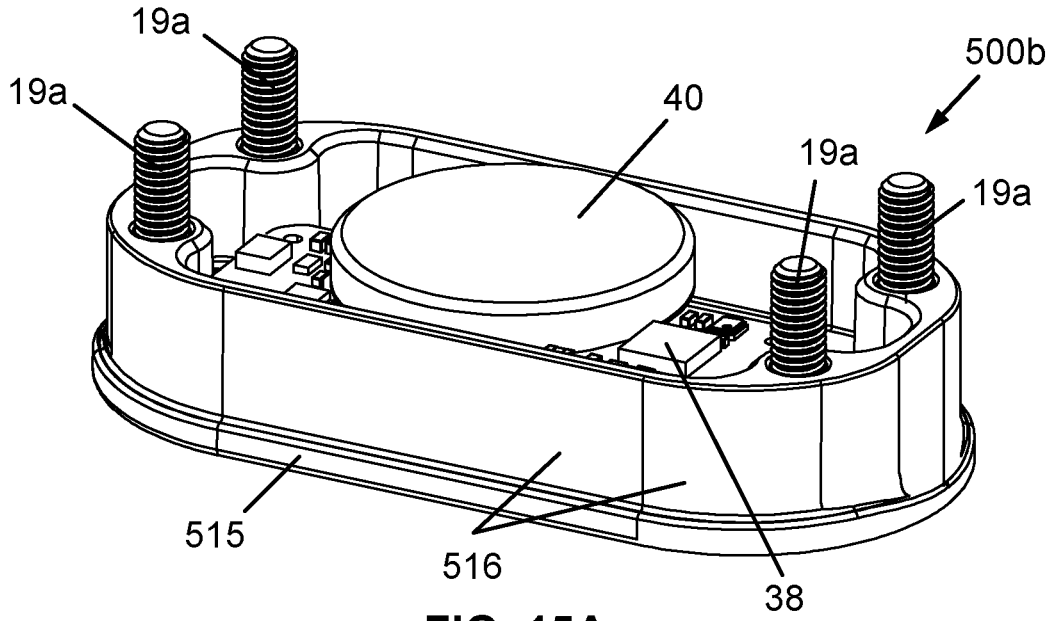
FIGS. 15A-15B, 16A-16B, and 17A-17B show apparatuses according to embodiments, including cross-sections of the apparatuses while introduced in a cavity.
Figure 15B:
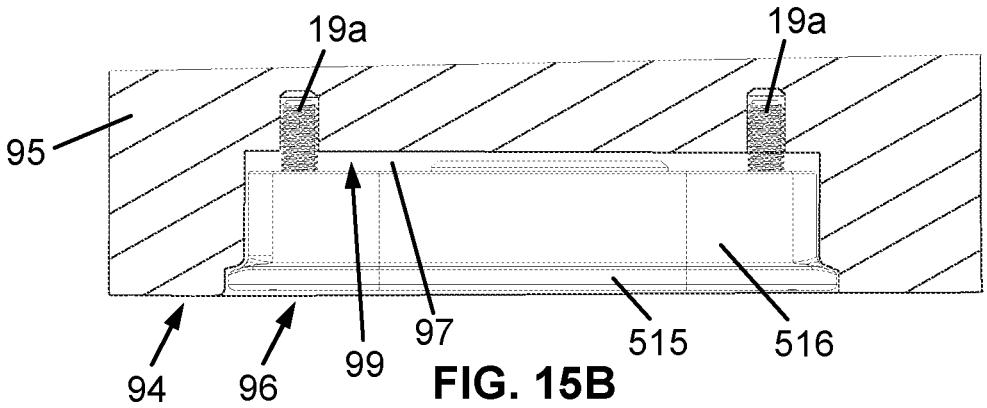

FIG. 15A shows a perspective of an apparatus 500*b*, and FIG. 15B shows a cross-section of said apparatus 500*b* while introduced in a cavity 97.

The apparatus 500*b* comprises, in addition to the sheet 515, one or more side walls 516 extending from the sheet 515 so as to form an open receptacle intended to provide additional protection to the hosted electronic device and to increase the rigidity of the apparatus 500*b*. The one or more side walls 516 can be mechanically coupled to the sheet 515, for instance they can be welded together, or the sheet 515 can be bended so as to form the one or more side walls 516, i.e. the sheet 515 integrally provides the side wall or walls.

As aforesaid, the battery 40 is a button cell to reduce the profile of the apparatus 500*b*.

The screws 19*a* go all the way through the sheet 515 and the side walls 516, but in other embodiments the through holes for the screws 19*a* are arranged in the sheet 515 only, i.e. they are outside of the projection of the walls 516. The screws 19*a* fix the apparatus 500*b* to the cavity 97, which has holes arranged in at least one wall 99 thereof.

The apparatus 500*b* is preferably arranged such that the sheet 515 is covering an opening 96 of the cavity 97, and is preferably arranged flush with a surface 94 where the opening 96 is formed. In this way, the propagation of the electromagnetic waves radiated by the slot antenna is enhanced, and electromagnetic waves can be received with higher power than in an arrangement in which the sheet 515 is provided within the cavity 97.

As it can be appreciated, the electronic device of the apparatus 500*b* is arranged on a face of the sheet 515 that is facing inwardly with respect to the cavity 97. In this manner, the sheet 515 and the walls 99 of the cavity 97 delimit a chamber that is protected by each of these members; the one or more side walls 516, in the embodiments in which the apparatus 500*b* comprises it/them, also serve to protect the chamber. The ingress of particles may be further reduced by providing a dielectric material in the slot of the slot antenna so as to cover it. And since the slot antenna is not within this chamber, the Faraday cage formed by the sheet 515 and the walls 99 does not affect the radioelectric performance of the slot antenna.

Figure 16A:
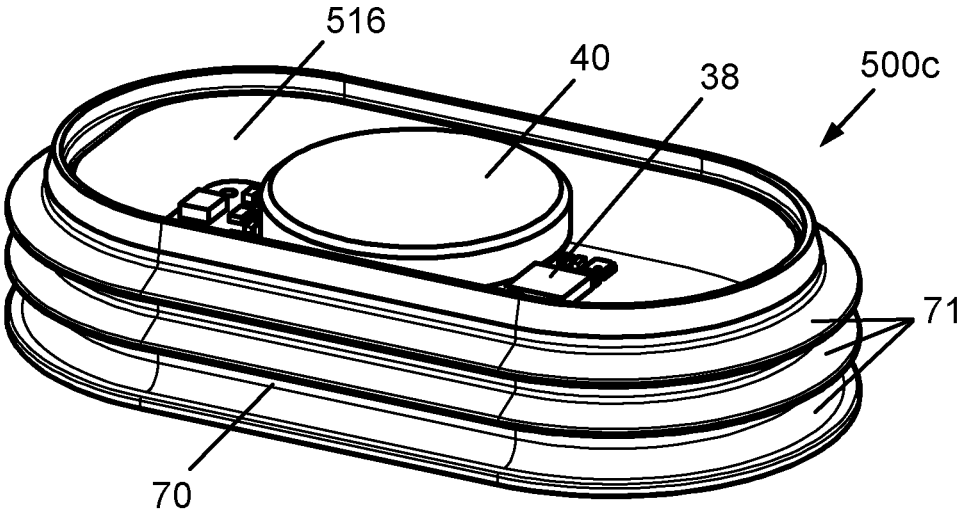
Figure 16B:
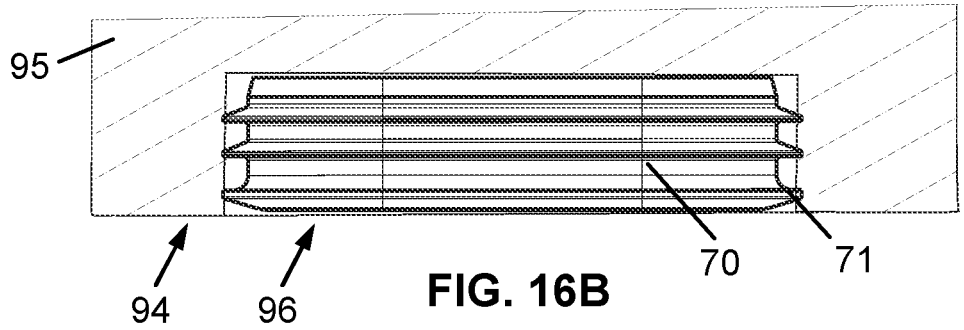

FIG. 16A shows a perspective of an apparatus 500*c*, and FIG. 16B shows a cross-section of said apparatus 500*c* while introduced in a cavity 97.

The apparatus 500*c* is similar to apparatus 500*b* of FIGS. 15A-15B, but instead of screws, the apparatus 500*c* comprises a cap 70 arranged on the sheet 515 as fastening means. The cap 70 includes protrusion(s) 71 or fin(s) for fixing the apparatus 500*c* to the walls 99 of the cavity 97 and producing friction that maintains the apparatus 500*c* introduced therein more reliably. The apparatus 500*c* preferably also comprises the one or more side walls 516 (or the sheet 515 bended to form a side wall or walls) so that the cap 70 is supported by the side wall(s).

Figure 17A:
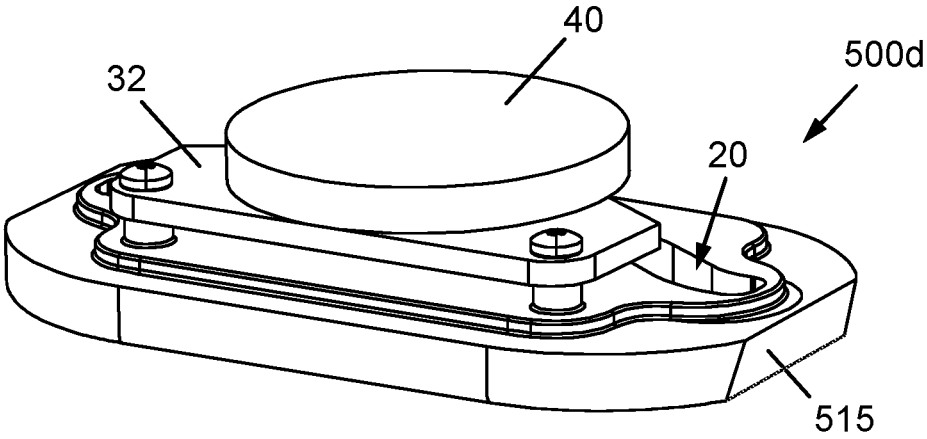
Figure 17B:
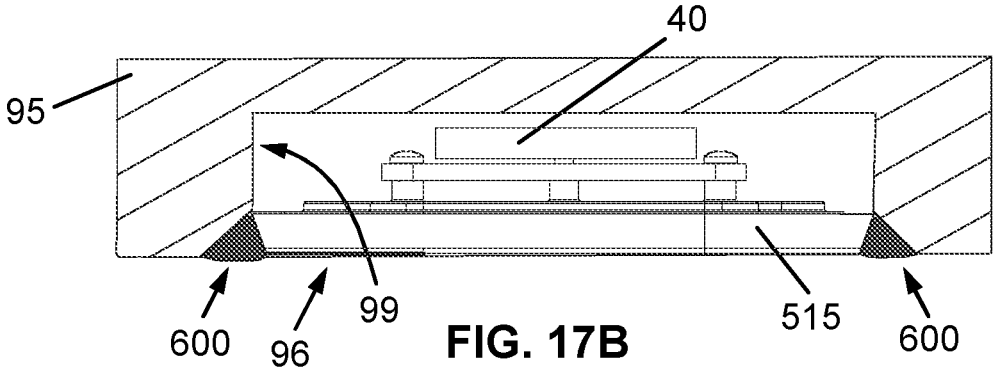

FIG. 17A shows a perspective of an apparatus 500*d*, and FIG. 17B shows a cross-section of said apparatus 500*d* while introduced in a cavity 97.

The apparatus 500*d* comprises the sheet 515 and, as fastening means, one or more edges thereof are welded to walls 99 or a surface 94 where the opening 96 of the cavity 97 is formed, thereby forming one or more welding joints 600. One or more edges of the sheet 515 can be arranged forming an angle different from 90° with respect to a largest surface of the sheet 515, i.e. they are not perpendicular to a largest surface thereof (i.e. that in which the slot antenna is arranged) which may ease the welding process.

Figure 18:
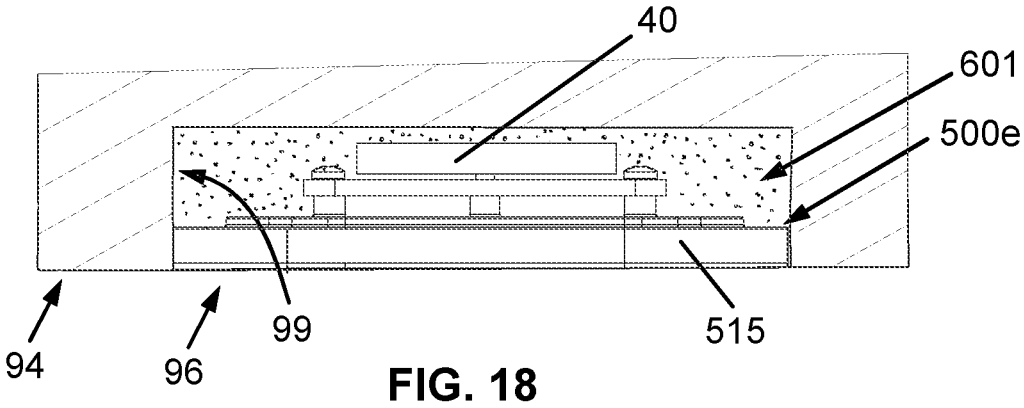
FIG. 18 shows a cross-section of an apparatus according to embodiments while introduced in a cavity.

FIG. 18 shows a cross-section of an apparatus 500*e* while introduced in a cavity 97.

The apparatus 500*e* comprises dielectric material 601 attached to the sheet 515 and electronic device, and also attached to walls 99 of the cavity. The dielectric material 601 is preferably applied by means of a potting process.

With reference to FIGS. 14A to 18, in those embodiments in which the sheet 515 comprises one or more grooves 25, and one or more Hall-effect sensors are arranged in one of those grooves 25, then said grooves 25 are preferably on a face of the sheet 515 that is facing outwardly with respect to the cavity 97 so that the sensor(s) may sense towards the outside of the device 95 without being blocked by the metallic material of the sheet 515. The Hall-effect sensors are capable of detecting magnetic fields, and better detect them when arranged in such a groove since fewer alterations of the magnetic fields exist than in the other face of the sheet 515. The sensor can be used for fall detection of the device of the earth moving machine from another device of the earth moving machine, e.g. a wear element like a tooth from another wear element like an intermediate adapter, a weld-on adapter or a mechanically-attached adapter. To this end, the sensor detects magnetic fields from one or more magnets arranged on the other device such that the magnetic fields thereof are measurable by the Hall-effect sensor.

In other embodiments, the electronic device of apparatuses as described with reference to FIGS. 14A to 18 do not include the battery 40, in which case the device and the slot antennas can be energized by a separate power source.

Figure 19A:
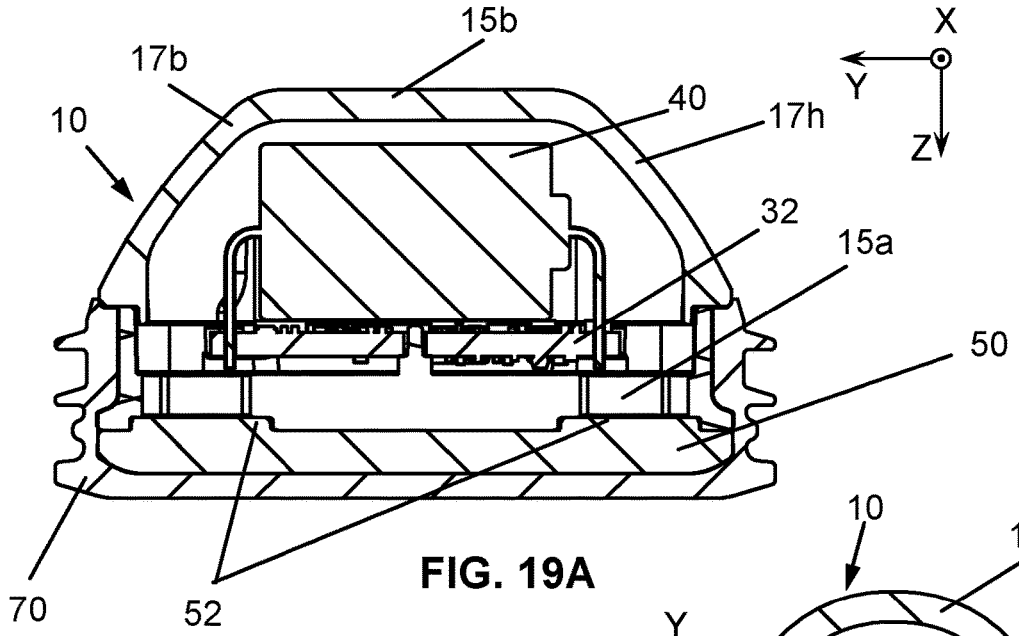
FIGS. 19A-19B show different cross-sections of a capsule according to embodiments.
Figure 19B:
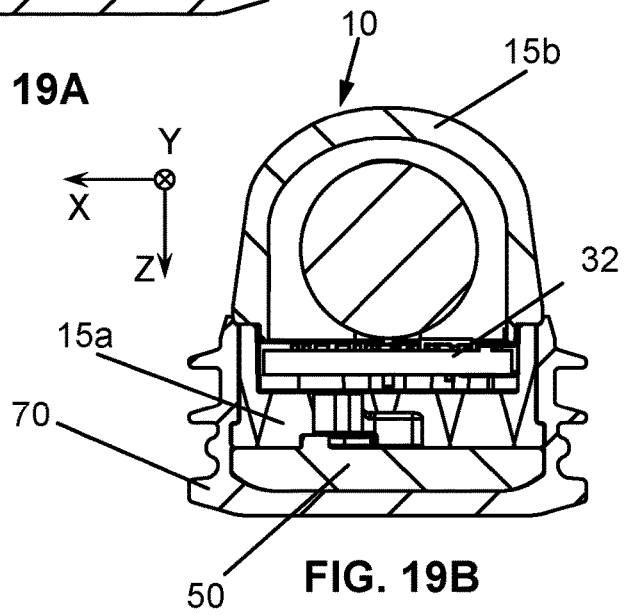

FIGS. 19A-19B show different cross-sections of a capsule 10 according to embodiments.

The capsule 10 includes a plurality of walls 15*a*-15*b*, and although not seen one of the walls 15*a* has a slot antenna arranged thereon. Within the inner chamber formed by the plurality of walls 15*a*-15*b* is a PCB 32 electrically connected with the slot antenna and a battery 40.

The capsule 10 further includes a protector 50 arranged adjacent to the wall 15*a* with the slot antenna, particularly on an external surface thereof. The protector 50, which is also illustrated in FIGS. 20A-20B, protects said wall 15*a* from e.g. fines.

In embodiment in which the capsule 10 comprises a cap 70, like in FIGS. 19A-19B, the protector 50 is preferably between the cap 70 and the wall 15*a* with the slot antenna.

Figure 20A:
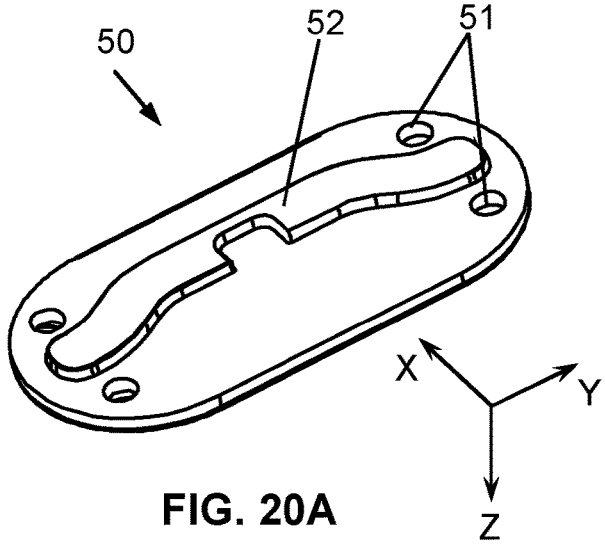
FIGS. 20A-20B show different views of a protector as provided in a capsule according to embodiments like those of FIGS. 19A-19B.
Figure 20B:
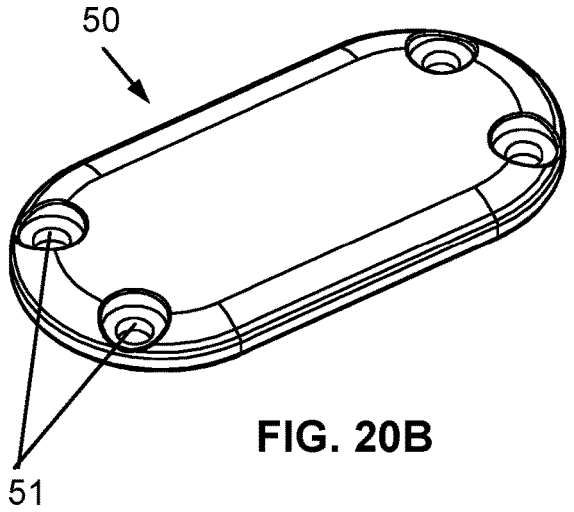

FIGS. 20A-20B show different views of a protector 50 as provided in a capsule according to embodiments, like those of FIGS. 19A-19B.

The protector 50 is made of an electrically non-conductive material so as not to interfere with the transmission and/or reception of wireless signals by the slot antenna. The material of the protector 50 is preferably selected to make the protector 50 rigid, including but not limited to electrically non-conductive alloys.

The protector 50 is preferably be provided with attaching means 51, in this case through holes for the introduction of screws, albeit other attaching means are possible as well, including adhesive. On one face of the protector 50 there is preferably a protrusion 52 shaped and dimensioned according to the slot of the slot antenna. When the protector 50 is arranged like in FIGS. 19A-19B, namely on the external surface of the capsule, the face with the protrusion 52 is facing towards the inner chamber, and positively couples with the slot of the slot antenna.

Figure 21:
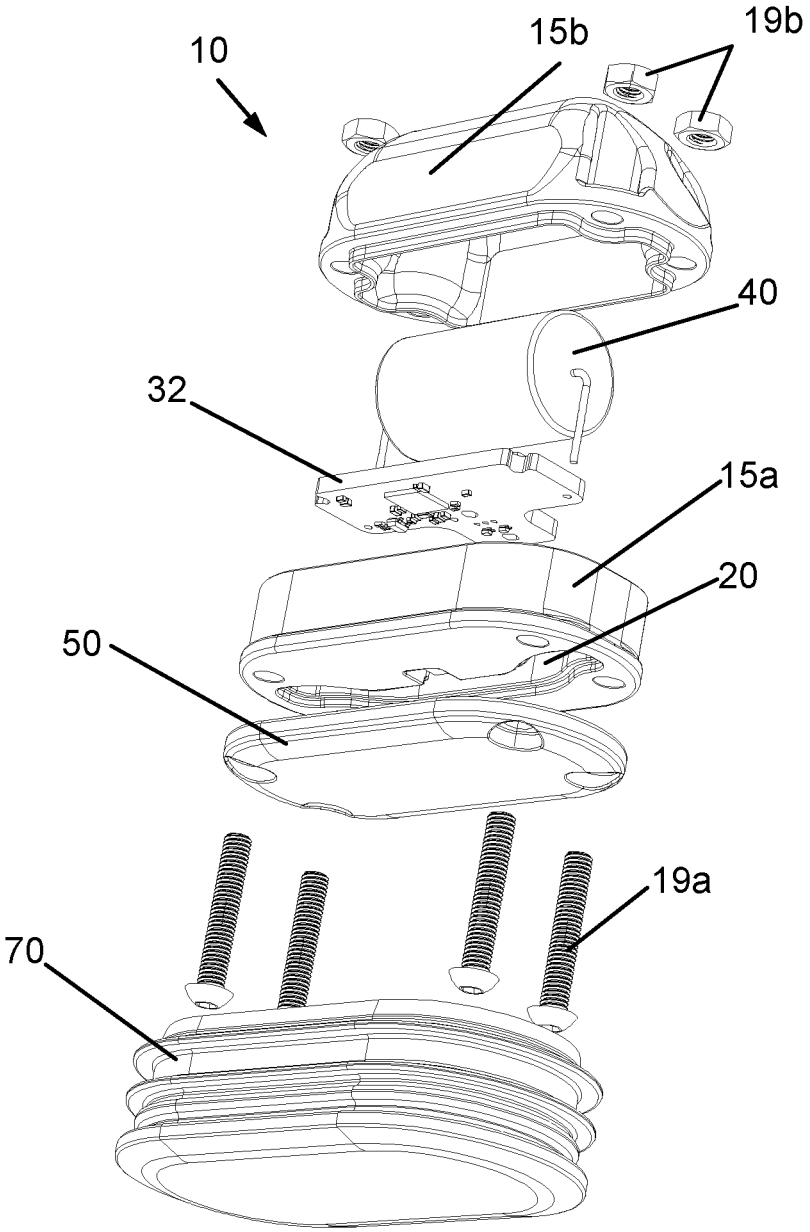
FIG. 21 shows an exploded view of a capsule according to embodiments.

FIG. 21 shows an exploded view of a capsule 10 according to embodiments.

The capsule 10 at least includes the plurality of walls 15*a*-15*b* providing the inner chamber, a battery 40, a PCB 32, a slot antenna 20 in one of the walls 15*a*, a protector 50, attaching means in the form of screws 19*a* and cooperating nuts 19*b*, and a cap 70.

In this text, the term "comprises" and its derivations (such as "comprising", etc.) should not be understood in an excluding sense, that is, these terms should not be interpreted as excluding the possibility that what is described and defined may include further elements, steps, etc.

On the other hand, the disclosure is obviously not limited to the specific embodiment(s) described herein, but also encompasses any variations that may be considered by any person skilled in the art (for example, as regards the choice of materials, dimensions, components, configuration, etc.), within the general scope of the invention as defined in the claims.

What is claimed is:

1. A capsule for protecting an electronic device for an earth moving machine, the capsule comprising walls enclosing an inner chamber configured for housing an electronic device; characterized in that the capsule comprises a slot antenna arranged in at least one of the walls, and the at least one of the walls in which the slot antenna is arranged is a cover, wherein the cover can be removably coupled to one or more walls of the walls of the capsule.

2. The capsule of claim 1, wherein the slot antenna is adapted for operation at a frequency less than 1000 MHZ.

3. The capsule of claim 2. wherein the slot antenna is adapted for operation at a frequency between 430.0 MHiz and 440.0 MHz.

4. The capsule of claims 1, further comprising dielectric material filling the slot of the slot antenna.

5. The capsule of claims 1, wherein the at least one of the walls has a maximum length in a particular longitudinal direction, a maximum width in a particular first transversal direction and a thickness in a second transversal direction, wherein the maximum length is greater than or equal to the maximum width and wherein the slot antenna has a maximum length in the longitudinal direction which is at least 60% and is less than or equal to 100% of the maximum length of the at least one of the walls.

6. The capsule of claims 1, further comprising the electronic device, wherein the electronic device comprises an electric power source and is at least configured for wireless data transmission; wherein the electronic device is electrically connected to the slot antenna; and wherein the inner chamber houses the electronic device or at least one or more components thereof.

7. The capsule of claim 6, wherein the electronic device further comprises at least one sensor configured for sensing one or more of: strain, wear, pressure, temperature, acceleration, position, material or terrain, or falling off of a wear element.

8. The capsule of claims 1, wherein slot antenna has a single straight segment or a plurality of segments, each segment being connected to one or more other segments.

9. The capsule of claims 1, wherein the cover where the slot antenna is arranged comprises an electrically conductive material.

10. A device for an earth moving machine, comprising:

a capsule comparing walls enclosing an inner chamber configured for housing an electrical device, a slot antenna arranged in at least one of the walls, and the at least one of the walls in which the slot antenna is arranged is a cover;

wherein the cover can be removably coupled to one or more walls of the walls of the capsule;

wherein the device is one of: a wear element digging implements a boom, a stick, a hydraulic cylinder, traction means, or a cabin.

11. The device of claim 10, further comprising a cavity having the capsule arranged therein.

12. The device of claim 11, wherein the device is a wear element comprising a tooth, and wherein one of:

the cavity is inside a female portion of the tooth;

the cavity is on a surface of the tooth at an end opposite a wear end of the tooth; or the cavity is on an external surface.

13. The device of claims 12, wherein an outermost surface of the at least one of the walls having the slot antenna arranged therein is flush with a surface of the wear element where an opening of the cavity is formed.

14. The device of claim 11, wherein the device is a wear element comprising an adapter or an intermediate adapter, the adapter or the intermediate adapter having a male portion adapted for insertion into a female portion of a tooth and delimiting a first end of the wear element, and a rear portion delimiting a second end of the wear element, and wherein one of:

the cavity is in the male portion, either on a surface at a tooth engaging end, or adjacent to a through hole of the adapter or intermediate adapter for receiving a pin for mechanically coupling the adapter or the intermediate adapter with the tooth and preferably parallel to the through hole; or the cavity is in the rear portion either on a surface from which the male portion protrudes, or on an external surface.

15. A process of, comprising:

manufacturing walls of a capsule of an alloy using a mold, or manufacturing the walls of the capsule of a resin with a potting process using a device for an earth moving machine as a mold wherein at least one wall of the walls comprises or is made of electrically conductive material;

forming or adding a slot antenna in the at least one wall;

wherein the at least one wall is manufactured such that it forms a cover that can be removably coupled to one or more walls of the walls of the capsule to close the inner chamber.

16. The process of claim 15, wherein the process comprises the step of manufacturing the walls with the potting process, and the potting process is carried out with the electronic device of the capsule introduced in the mold.

17. The process of claim 16, further comprising carrying out a potting process on the manufactured capsule so as to at least fill the slot of the slot antenna with dielectric material.

18. The process of any one of claims 15, further comprising:

providing attaching means; and coupling the cover with the one or more walls using the attaching means in a removable manner.

19. The process of claim 15, further comprising;

forming, on a device for an earth moving machine, a cavity for receiving the capsule; and indroducing the capsule in the formed cavity.

20. The process of claim 15, wherein the process comprises the step of manufacturing the walls using the mold.

* * * * *